US007683746B2

(12) United States Patent
Nakanishi

(10) Patent No.: US 7,683,746 B2
(45) Date of Patent: Mar. 23, 2010

(54) ELECTRO-MECHANICAL SWITCH

(75) Inventor: Yoshito Nakanishi, Tokyo (JP)

(73) Assignee: Panasonic Corporation, Osaka (JP)

( * ) Notice: Subject to any disclaimer, the term of this patent is extended or adjusted under 35 U.S.C. 154(b) by 400 days.

(21) Appl. No.: 10/592,988

(22) PCT Filed: Jan. 20, 2006

(86) PCT No.: PCT/JP2006/300889

§ 371 (c)(1),
(2), (4) Date: Sep. 15, 2006

(87) PCT Pub. No.: WO2006/077987

PCT Pub. Date: Jul. 27, 2006

(65) Prior Publication Data

US 2008/0060919 A1 Mar. 13, 2008

(30) Foreign Application Priority Data

Jan. 21, 2005 (JP) ..... 2005-014019
Jan. 20, 2006 (JP) ..... 2006-012529

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 6,218,911 B1 4/2001 Kong et al.

(Continued)

FOREIGN PATENT DOCUMENTS

JP 8-212879 8/1996

(Continued)

OTHER PUBLICATIONS

Microfilm of the specification and drawings annexed to the request of Japanese Utility Model Application No. 109193/1977 (Laid-open No. 35376/1979), Maranz Japan, Inc., Mar. 8, 1979, p. 2, line 8 to p. 3, line 19; Figs. 1 to 2.

(Continued)

*Primary Examiner*—Elvin G Enad
*Assistant Examiner*—Bernard Rojas
(74) *Attorney, Agent, or Firm*—Pearne & Gordon LLP

(57) ABSTRACT

The present invention provides an electromechanical switch enabled to achieve a high-speed switching response at a low driving voltage. An electromechanical switch body 10, which is an MEMS switch, has a first movable electrode 14 and a second movable electrode 16, both ends of each of which are respectively fixed to and laid on a first anchor 12 and a second anchor 13 formed on a silicon substrate 2, and also has a fixed electrode 18 that faces these movable electrodes. A first electromechanical switch 22 enabled to be driven at a low voltage is constituted by the first movable electrode 14, which has a relatively weak spring force, and the fixed electrode 18. A second electromechanical switch 24 enabled to be latched at a low voltage is constituted by the second movable electrode 16, which has a relatively strong spring force, and the fixed electrode 18. Consequently, the first movable electrode 14 is displaced at high speed at a low driving voltage, so that the first electromechanical switch is turned on at high speed. A restoring force causes the second movable electrode 16 to perform natural vibrations at high speed, so that the second electromechanical switch is turned off at high speed. The restored second movable electrode 16 is latched at a low driving voltage, so that the second electromechanical switch is turned on.

22 Claims, 20 Drawing Sheets

U.S. PATENT DOCUMENTS

| | | | | |
|---|---|---|---|---|
| 6,621,387 | B1 * | 9/2003 | Hopcroft | 333/262 |
| 6,720,851 | B2 * | 4/2004 | Hallbjorner et al. | 335/78 |
| 6,891,454 | B1 | 5/2005 | Naito et al. | |
| 7,053,736 | B2 * | 5/2006 | Nelson | 335/70 |
| 7,138,893 | B2 * | 11/2006 | Nakanishi et al. | 335/78 |
| 7,280,014 | B2 * | 10/2007 | Potter | 335/78 |
| 7,342,472 | B2 * | 3/2008 | Charvet | 335/78 |
| 7,446,634 | B2 * | 11/2008 | Jeong et al. | 335/78 |

FOREIGN PATENT DOCUMENTS

| | | |
|---|---|---|
| JP | 2000-311572 | 11/2002 |
| JP | 2004-111360 | 4/2004 |
| JP | 2004-134370 | 4/2004 |
| JP | 2004-327441 | 11/2004 |
| JP | 2001-84884 | 9/2006 |

OTHER PUBLICATIONS

Rebeiz et al., "MEMS Switch Library", Feb. 1, 2003, p. 122.

* cited by examiner

MEMS SWITCH OFF-STATE

MEMS SWITCH ON-STATE

ELECTRO-MECHANICAL SWITCH

TECHNICAL FIELD

The present invention relates to a microelectromechanical systems switch (hereunder referred to as "MEMS" switch) and, more particularly, to an electromechanical switch at a low driving voltage.

BACKGROUND ART

Semiconductor RF-switches (Radio Frequency and Microwave Switches), such as a HEMT switch, an MESFET switch, and a PIN diode switch which use GaAs substrate, are currently the mainstream of RF-switches.

However, to achieve higher performance and lower power consumption of radio terminals, it has been proposed to utilize a device using microelectromechanical elements in addition to conventional semiconductor elements.

This device is an electromechanical switch adapted to drive microelectrodes by an electrostatic force or the like and to mechanically control the relative distance between the electrodes thereby to perform the turn-on or the turn-off of signals. At the turn-on, the electrodes are electrically in contact with each other. Therefore, the loss between the electrodes is extremely small and a low-loss switch can be realized.

Especially, an RF-switch applied to the front end portion of a radio terminal requires low loss and low power consumption. Such a device using microelectromechanical elements is expected as a useful resolution method.

Many kinds of switches using conventional electromechanical elements have been devised. Non-patent Document 1 covers most of such switches.

For example, a switch using RFMEMS (Radio Frequency Microelectromechanical Systems) described in Non-patent Document 1 is constituted by one movable electrode and one fixed electrode. When a DC voltage is applied between the movable electrode and the fixed electrode as a drive control voltage, an electrostatic force is generated. The movable electrode is pulled in toward the fixed electrode using the electrostatic force as a driving force. The electrodes are physically in contact with each other. An input signal inputted from a movable-electrode-side input terminal is outputted to a fixed-electrode-side output terminal, so that signals are coupled.

A method of coupling signals includes a method of bringing metal into direct contact with metal and a method of capacitively coupling metals through an insulator. Either of the methods can realize low-loss coupling.

When the drive control voltage applied between the electrodes is changed to 0, the electrostatic force is canceled. The movable electrode is returned to an initial position, utilizing a spring force thereof as a driving force. At that time, the distance between the movable electrode and the fixed electrode is sufficiently large. Thus, the capacitance value between the electrodes is small. Consequently, no capacity coupling therebetween occurs. Signals to be coupled between the electrodes can be shielded.

Thus, when the distance between the electrodes is sufficiently large, the isolation therebetween can sufficiently be ensured. Also, the loss is extremely small. This switch excels in electrical properties, as compared with the RF switch using conventional semiconductors.

Also, an MEMS switch of this kind has been proposed by Patent Document 1.

An object of the MEMS switch described in Patent Document 1 is to reduce a response time and an application voltage. This switch has first, second, and third beams arranged to be spaced slightly distant, and voltage applying means adapted to apply an electrostatic force to the beams. This switch is configured so that the position of each of the beams and the capacity between the beams are changed by the electrostatic force. Both of the first beam and the second beam are moved, so that the beams can electrically be coupled together at high speed. Also, to put off the beams at high speed, an electrostatic force is caused on the third beam that faces the second beam and that is preliminarily placed close to the first beam and the second beam. Consequently, a strong electrostatic force can be applied between the second beam and the third beam. Thus, this switch makes a response at higher speed.

Additionally, a same-curve-shaped part is provided in each of the beams. This can alleviate change in a pull-in voltage, which corresponds to change in the internal stress of the beam, and also can alleviate change in the beam-to-beam capacitance due to beam strain.

Non-Patent Document 1: Gabriel M. Rebeiz, "RF MEMS THEORY, DESIGN, AND TECHNOLOGY", John Wiley & Sons, Feb. 1, 2003, p. 122.

Patent Document 1: JP-A-2004-111360 (pages 5 and 6, FIG. 1, and FIG. 3(a) to FIG. 3(f)).

DISCLOSURE OF THE INVENTION

Problems that the Invention is to Solve

However, the MEMS switch described in Non-patent Document 1 requires a strong electrostatic force, because a movable electrode having a finite mass is moved by using an electrostatic force as a driving force. Also, the MEMS switch has a problem in that a response time required to turn on or off the MEMS switch is equal to or more than several 10 μs and is extremely long, as compared with a response time required to turn on or off the switch using conventional semiconductor elements is of the order of nanoseconds (ns).

For example, Non-patent Document 1 summarizes the driving voltage and the response time of each of the electromechanical switches, which have already been published. The minimum response time is 4 μs. However, an extremely high voltage of 40V or higher is applied thereto (Non-patent Document 1, p. 16).

In a case where the MEMS switch is applied to a radio communication terminal, a driving voltage is limited, so that the MEMS switch should be operated at a voltage that is several volts or less. Also, in the case of some radio system to which the MEMS switch is applied, for example, in the case of some wireless LAN system, the MEMS switch is required to turn on or off in an extremely short time of 0.2 μs. In the case of an example described in Non-patent Document 1, a required response time is 4 μs or so.

This is due to the fact that although it is necessary for ensuring desired isolation to set the distance between the electrodes at a large value, the response time is inevitably long when the distance therebetween is large, in addition to the limitation to the driving voltage of the radio communication terminal.

Also, when the movable electrode of he MEMS switch is pulled in toward the fixed electrode thereof, the electrostatic force is used. However, when the movable electrode is pulled away therefrom, the spring force of the movable electrode is used. To equalize a response time, which is required to turn on the switch, to a response time required to turn off the switch, it is necessary to set the magnitude of the spring force of the movable electrode at a value higher than a certain value. In a case where the spring force serving as the driving force is increased, a higher driving voltage is inevitably needed because an electrostatic force should be applied against this spring force when the movable electrode is pulled in toward the fixed electrode.

Therefore, the MEMS switch described in Non-patent Document 1 has a problem in that the driving voltage is extremely high.

Also, an example described in Patent Document 1 is adapted so that all of the beams is movable thereby to enable high-speed switching and to enable operations at low DC potential. However, there have been increasing demands for a switch enabled to perform high-speed switching and to have a lower driving voltage.

The invention is accomplished in view of the above circumstances. An object of the invention is to provide an electromechanical switch enabled to achieve a high-speed switching response at a low driving voltage.

Means for Solving the Problems

To achieve the foregoing object, an electromechanical switch according to the invention includes an MEMS switch, which comprises a first electromechanical switch adapted to turn on and off according to a displacement of at least a first beam that is restorable by a relatively weak spring force, and also comprises a second electromechanical switch adapted to turn on and off according to a displacement of at least a second beam that is restorable by a relatively strong spring force. In an initial condition, the electromechanical switch is brought into an off-state on condition that the first electromechanical switch is off, and that the second electromechanical switch is on.

With this configuration, the first electromechanical switch is turned on at high speed. Also, the second electromechanical switch is turned off at high speed. Thus, an electromechanical switch, which is enabled to be driven at a low voltage and to perform a switching response at high speed, can be provided.

Additionally, this electromechanical switch performs a mechanical switching operation, so that high-degree isolation can be ensured with low loss.

Also, the electromechanical switch of the invention includes an electromechanical switch in which the first beam is displaced from the initial condition by one of application and cancellation of a driving force, and in which the first electromechanical switch is tuned on in response to displacement of the first electromechanical switch to thereby bring the electromechanical switch into an on-state.

With this configuration, an on-response to mechanical switching can be achieved at high speed.

Also, the electromechanical switch of the invention includes an electromechanical switch in which in a case where both of the first electromechanical switch and the second electromechanical switch are on, the displacement of the first beam and the displacement of the second beam are simultaneously eliminated to perform a restoring operation thereby to turn off the second electromechanical switch, so that the electromechanical switch is brought into an off-state.

With this configuration, an off-response to mechanical switching can be achieved at high speed.

Also, the electromechanical switch of the invention includes an electromechanical switch in which the second beam starts performing natural vibrations by turning off the second electromechanical switch, and in which the second beam is latched by one of application and cancellation of a driving force in a case where the second beam is returned to the vicinity of a displacement position thereof at which the second electromechanical switch is turned off.

With this configuration, the second electromechanical switch can be latched by performing a low-voltage operation.

Also, the electromechanical switch of the invention includes an electromechanical switch in which at least one of a displacement of the first beam and a displacement of the second beam is based on an electrostatic force.

Also, the electromechanical switch of the invention includes an electromechanical switch in which at least one of a displacement of the first beam and a displacement of the second beam is based on an electromagnetic force.

Also, the electromechanical switch of the invention includes an electromechanical switch in which at least one of a displacement of the first beam and a displacement of the second beam is based on a piezoelectric effect.

Also, the electromechanical switch of the invention includes an electromechanical switch in which at least one of a displacement of the first beam and a displacement of the second beam is based on a thermal expansion.

With these configurations, the beam can be displaced by performing a low-voltage operation.

Also, the electromechanical switch of the invention includes an electromechanical switch which further comprises a common fixed electrode, to which the first beam and the second beam face in parallel through an air gap, and which is adapted so that the first electromechanical switch is configured by including the fixed electrode and the first beam, and that the second electromechanical switch is configured by including the fixed electrode and the second beam.

With this configuration, a speed of performing an operation of electrically connecting the first beam to the fixed electrode can be adjusted to a value differing from a speed of performing an operation of electrically connecting the second beam to the fixed electrode. Consequently, dual pole double throw switching is enabled.

Also, the electromechanical switch of the invention includes an electromechanical switch in which the air gap to the fixed electrode is provided according to the maximum amplitude of natural vibrations of each of the first beam and the second beam.

With this configuration, the operating speed of the first electromechanical switch can be set to be different from that of the second electromechanical switch. Thus, isolation can be ensured.

Also, the electromechanical switch of the invention includes an electromechanical switch which is brought into an on-state only when the first electromechanical switch is on and the second electromechanical switch is on.

With this configuration, the electromechanical switch is turned on only by turning on the first electromechanical switch when the first beam is displaced from the initial state at high speed. Consequently, an on-response can be achieved at high speed.

Also, the electromechanical switch of the invention includes an electromechanical switch adapted so that the first beam and the second beam are arranged in parallel to each other, that a third beam enabled to be restored by a spring force, which is relatively weaker than a spring force of the second beam, is arranged in parallel thereto, that the first electromechanical switch is configured by including the first beam and the second beam, and that the second electromechanical switch is configured by including the second beam and the third beam.

With this configuration, the second beam of the second electromechanical switch is displaced at high speed. Consequently, on/off operations can be performed at high speed.

Also, the electromechanical switch of the invention includes an electromechanical switch in which the air gap between the second beam and each of the first beam and the third beam is formed according to the maximum amplitude of natural vibrations of the second beam.

With this configuration, a high-speed response is enabled by setting the natural frequency of the second beam.

Also, the electromechanical switch of the invention includes an electromechanical switch configured so that the displacement of the third beam is based on an electrostatic force.

With this configuration, the third beam can be displaced by performing a low-voltage operation.

Also, the electromechanical switch of the invention includes an electromechanical switch configured so that the displacement of the third beam is based on an electromagnetic force.

With this configuration, in addition to the above advantages, the invention has an advantage in that a linear change, which does not depend upon the displacement position (or gap), can be given. This is because the electromagnetic force does not depend upon a distance, whereas in the case of change caused by the electrostatic force, only (⅓) or so of the gap linearly changes due to a pull-in phenomenon.

Also, the electromechanical switch of the invention includes an electromechanical switch configured so that the displacement of the third beam is based on a piezoelectric effect.

With this configuration, in addition to the above advantages, the invention has an advantage in that displacements in both directions are facilitated.

Also, the electromechanical switch of the invention includes an electromechanical switch configured so that the displacement of the third beam is based on a thermal expansion.

With this configuration, in addition to the above advantages, the invention has an advantage in that a stronger contact force can be ensured.

Also, the electromechanical switch of the invention includes an electromechanical switch in which the beams include one of a piezoelectric element, a shape-memory alloy, a bimorph element, and an electromagnetic distortion element, or in which a plurality of beams include a combination of these elements.

With this configuration, each of the beams operates at low power. Thus, an operating voltage can be lowered.

Also, the electromechanical switch of the invention includes an electromechanical switch configured so that in a case where all of displacements of the first beam, the second beam, and the third beam are canceled, the second beam is brought closer to the third beam by a mechanical probe, and the second beam is latched by displacing the third beam by one of application and cancellation of a driving force.

With this configuration, the second beam is displaced and is brought closer to the third beam. Thus, the third beam can be operated at low power.

Also, the electromechanical switch of the invention includes an electromechanical switch in which the first electromechanical switch and the second electromechanical switch are placed in environment in which an air pressure differs from an atmospheric pressure or in environment filled with dried helium.

With this configuration, the influence of air or the like on the beam operating at high speed is suppressed. Thus, the damping effect can be reduced.

Also, the electromechanical switch of the invention includes an electromechanical switch in which the second electromechanical switch is off only for a time required by the first electromechanical switch to obtain predetermined isolation.

With this configuration, high-degree isolation can be ensured. Also, an off-operation can surely be achieved.

Also, the electromechanical switch of the invention includes an electromechanical switch adapted so that a cycle of natural vibrations of the second beam is equal to a time required by the first beam to reach a position at which the first beam obtains sufficient isolation.

Also, the electromechanical switch of the invention includes an electromechanical switch adapted so that in a case where the first electromechanical switch is on and where a state of a signal is switched from a passing state to a shielded state, the second beam reaches a position, at which the second beam obtains necessary isolation, until the first beam reaches a position required by the first beam to obtain predetermined isolation, and the second beam is returned to an initial latched state again.

With this configuration, the second beam operating at high speed ensures isolation. Also, after the first beam operating at relatively slow speed ensures isolation, the second beam can be latched.

Also, the electromechanical switch of the invention includes an electromechanical switch which further comprises a first lower spring movable electrode, a higher spring movable electrode, and a second lower spring movable electrode, which are arranged in parallel so that the first lower spring movable electrode includes the first beam, that the higher spring movable electrode includes the second beam, that the second lower spring movable electrode includes the third beam, that the first electromechanical switch has a first lower spring movable electrode including a first beam, and also has a first fixed electrode arranged to face the first beam, that the third electromechanical switch has a second low spring movable electrode including a third beam, and also has a third fixed electrode arranged to face the second beam, that the second electromechanical switch has a higher spring movable electrode including a second beam, and also has a first region extended from the first fixed electrode to face the higher spring movable electrode, and also has a second region extended from a second fixed electrode to face the higher spring movable electrode, and that the first beam and the second beam are mechanically connected to each other through a connecting portion.

Also, the electromechanical switch of the invention includes an electromechanical switch adapted so that the second beam is connected to the input terminal, and that the first beam and the second beam are connected to the first output terminal and the second output terminal, respectively.

With these configurations, the third beam is displaced in response to the displacement of each of the first beam and the second beam. Thus, even in a case where the first lower spring movable electrode is latched by the first fixed electrode due to some kind of a failure, the invention can prevent an occurrence of a state in which the higher spring movable electrode having a strong spring force cannot be pulled in and is finally placed at an intermediate position, that is, a state in which all of the first and second lower movable electrodes and the higher spring movable electrode are in an off-state.

Advantages of the Invention

In the electromechanical switch according to the invention, the first electromechanical switch enabled to operate by being driven at a low voltage is turned on at high speed. The second electromechanical switch enabled to be latched at a low voltage is turned off at high speed. Thus, the invention has advantages in that the electromechanical switch can operate at a low driving voltage and turn on and off at high speed according to the combination of the first electromechanical switch and the second electromechanical switch.

DESCRIPTION OF REFERENCE NUMERALS AND SIGNS

Figure 1:
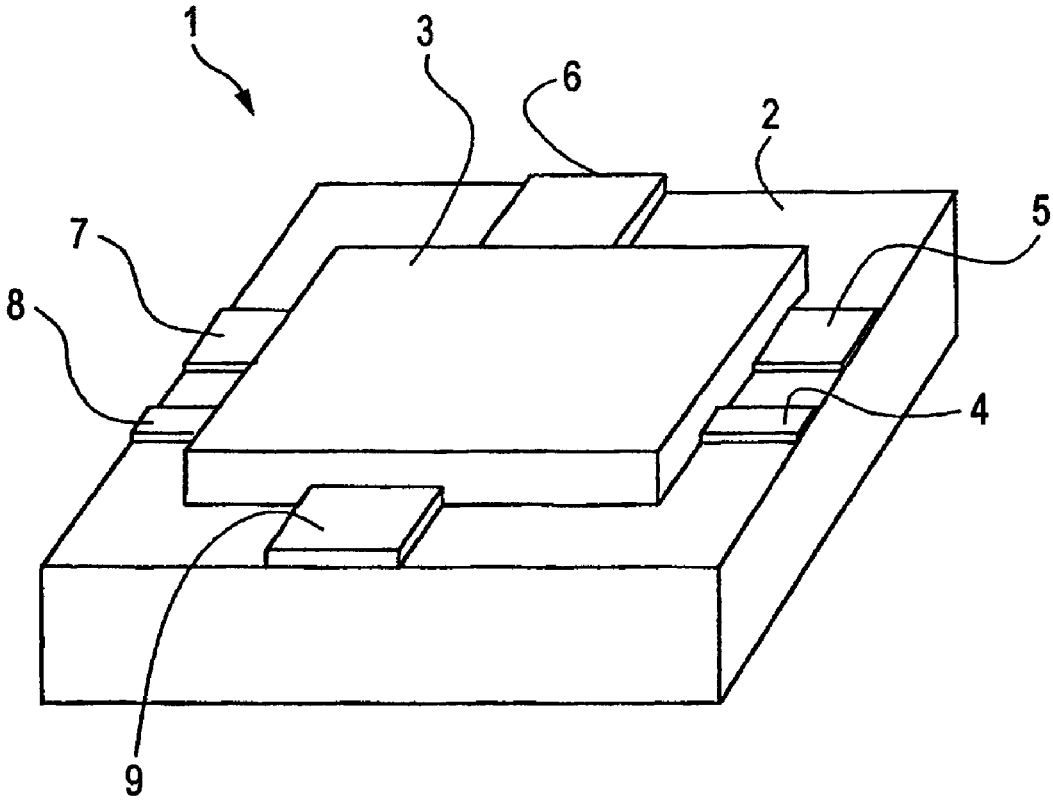
FIG. 1 is an external view illustrating the configuration of a unit element of an electromechanical switch according to a first embodiment.

1, 40, 70, 200 electromechanical switches
2 silicon substrate
3 sealed cover glass
4, 211 first electrode terminals
5, 212 second electrode terminals
6, 213 third electrode terminal
7, 214 fourth electrode terminal
8, 215 fifth electrode terminal
9, 216 sixth electrode terminal
10 electromechanical switch body
12, 72, 201 first anchors
13, 73, 203 second anchors
14, 74, 202 first movable electrodes
16, 76, 204 second movable electrodes
18, 62, 66, 78 fixed electrodes
22 first electromechanical switch
24 second electromechanical switch
31, 32 curves
60 parallel plate type
64, 68 movable electrodes
69 pectinate type
82 first concave portion
84 second concave portion
86 third concave portion
88 fourth concave portion
92, 94, 96 projection portions
102 sacrifice layer
104 resist layer
206 second movable electrode

BEST MODE FOR CARRYING OUT THE INVENTION

An electromechanical switch according to the invention is placed under reduced pressure or in helium gas atmosphere serving as environment in which the damping effect of the viscosity of air or the like is weakened. The electromechanical switch according to the invention is constituted by including a first electromechanical switch, in which a movable electrode having a weak spring force is pulled in toward a fixed electrode at high speed, and a second electromechanical switch in which a movable electrode having a strong spring force is pulled away from a fixed electrode. In a stationary state, signals can be switched only by turning on and off the first electromechanical switch.

Additionally, to allow a first electromechanical switch to obtain sufficient isolation in a transient state caused when a signal is shielded, the first electromechanical switch ensures isolation established within a time taken to make an electrode to be pulled away by a sufficient distance. The isolation in the transient state is ensured by bringing the second electromechanical switch into an off-state at high speed.

Also, the second electromechanical switch is adapted so that although a movable electrode is pulled away only for a moment, the movable electrode performs natural vibrations due to a strong spring force and to a weak damping effect, and that thus, the movable electrode returns to the neighborhood of an initial position. Consequently, the second electromechanical switch having a strong spring can be latched at a minute voltage.

Thus, the electromechanical switch according to the invention, which is a switch using a microelectromechanical elements, can achieve the on/off of a signal at high speed at a low driving voltage by combining the first electromechanical switch, which uses an electrode having a weak spring force and is pulled in at high speed and is restored at low speed, with the second electromechanical switch that uses an electrode having a strong spring force and is released from a latch and is immediately latched.

Hereinafter, a preferred embodiment of the electromechanical switch according to the invention is described below in detail. In the drawings, a same reference numeral is used to designate substantially the same or corresponding member.

FIRST EMBODIMENT

FIG. 1 is an external view illustrating the configuration of a unit element of an electromechanical switch according to a first embodiment.

Figure 2:
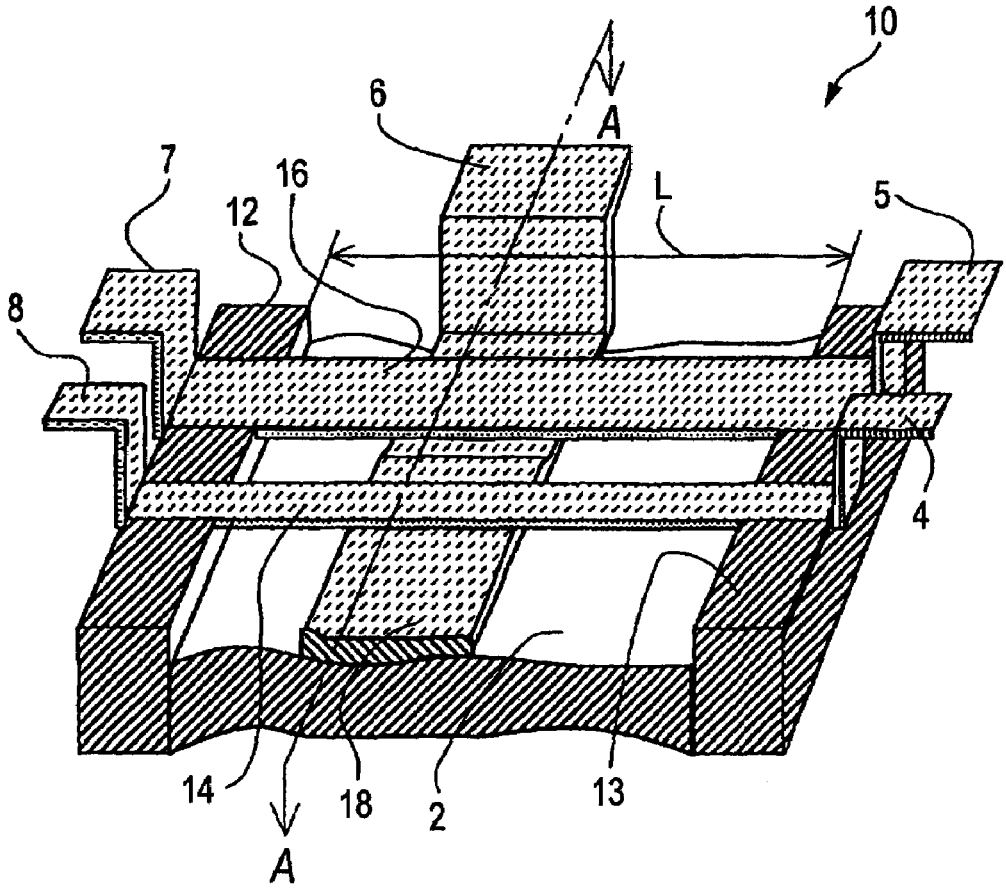
FIG. 2 is a partly cross-sectional view illustrating the configuration of a primary part of each of a first electromechanical switch and a second electromechanical switch of the first embodiment.

FIG. 2 is a partly cross-sectional view illustrating the configuration of a primary part of each of a first electromechanical switch and a second electromechanical switch of the first embodiment.

As shown in FIGS. 1 and 2, an electromechanical switch 1 according to the first embodiment has an electromechanical switch body 10, which is formed on a silicon substrate 2 and is covered by a sealed cover glass 3, and also has a first electrode terminal 4, a second electrode terminal 5, a third electrode terminal 6, a fourth electrode terminal 7, a fifth electrode terminal 8, and a sixth electrode terminal 9, which serve as input/output terminals.

As shown in FIG. 2, the electromechanical switch body 10 has a first movable electrode 14 and a second movable electrode 16, the both ends of each of which are fixed to and laid on a first anchor 12 and a second anchor 13 formed on the silicon substrate 2, and also has a fixed electrode 18 formed to face the first movable electrode 14 and the second movable electrode 16 across a predetermined air gap.

In the first embodiment, each of the first movable electrode 14 and the second movable electrode 16 is constructed as an inboard beam. The first movable electrode 14 and the second movable electrode 16 are configured so that the first movable electrode 14 has a relatively weak spring force, and that the second movable electrode 16 has a relatively strong spring force.

A first electromechanical switch 22 is configured to include the first movable electrode 14 and the fixed electrode 18. A second electromechanical switch 24 is configured to include the second movable electrode 16 and the fixed electrode 18. These electromechanical switches are series-connected to each other.

The first movable electrode 14 and the second movable electrode 16 perform natural vibrations using an electrostatic force generated according to the applied voltage and the spring forces of these movable electrodes themselves. An air gap having a size equal to or larger than the maximum amplitude of the natural vibrations is ensured.

To reduce the damping effect, this air gap is filled with dry helium. Alternatively, the air gap is maintained at vacuum.

Incidentally, the input/output terminals of the first movable electrode 14 are a first electrode terminal 4 and a fifth electrode terminal 8. The input/output terminals of the second movable electrode 16 are a second electrode terminal 5 and a fourth electrode terminal 7. The input/output terminals of the fixed electrode 18 are a third electrode terminal 6 and a sixth electrode terminal 9.

For example, in a case where the fifth electrode terminal 8 is used as a signal input terminal, the second electrode terminal 5 and the fourth electrode terminal 7 are signal output terminals.

Further, a control voltage supply used to apply an electrostatic force between the fixed electrode 18 and each of the first movable electrode 14 and the second movable electrode 16 can be connected to each of the electrode terminals.

Figure 3:
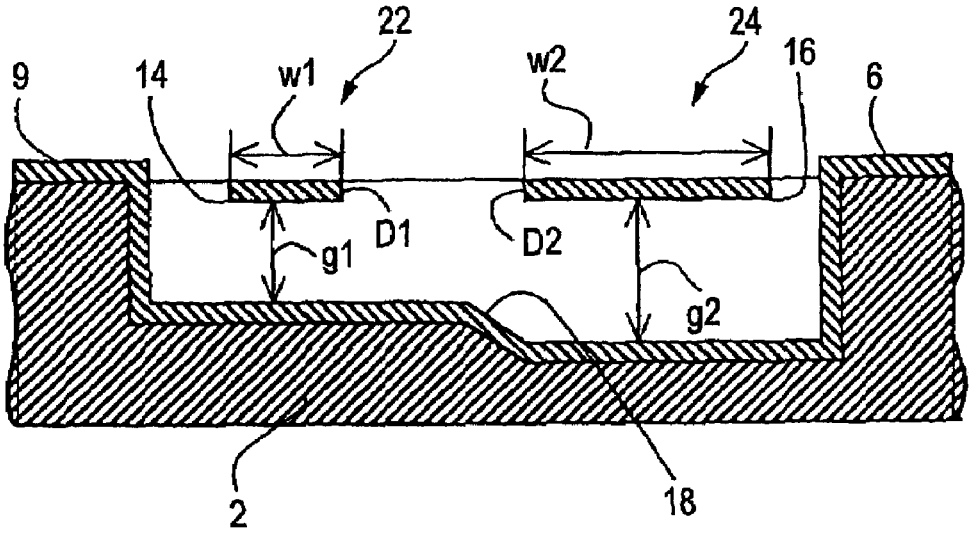
FIG. 3 is a cross-sectional view taken on line A-A shown in FIG. 2.

FIG. 3 is a cross-sectional view taken on line A-A shown in FIG. 2.

As shown in FIGS. 2 and 3, the lengths L1 and L2 (not shown) of the first movable electrode 14 and the second movable electrode 16 are set to be the same length L that is 400 μm. The widths w1 and w2 are set at 2.5 μm and 5 μm, respectively. The thicknesses D1 and D2 are to be the same thickness that is 0.4 μm. The gap g1 between the fixed electrode 18 and the electrode 14 and the gap g2 between the fixed electrode 18 and the electrode 16 are set at 0.2 μm and 1.5 μm, respectively.

Figure 4:
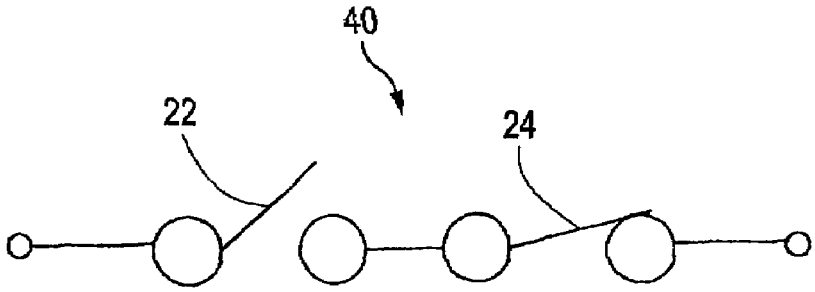
FIG. 4 is a circuit view illustrating an equivalent circuit of the electromechanical switch according to the invention.

FIG. 4 is a circuit view illustrating an equivalent circuit of the electromechanical switch according to the invention.

As shown in FIG. 4, an electromechanical switch 40 according to the invention has a first electromechanical switch 22 and a second electromechanical switch 24. In an initial condition, the first electromechanical switch 22 is in an off-state, while the second electromechanical switch 24 is in an on-state. In the initial condition, the electromechanical switch 40 is off.

That is, in the initial condition, a drive control voltage is applied to the second movable electrode 16. The second movable electrode 16 is electrically connected to the fixed electrode 18 by an electrostatic force. However, no drive control voltage is applied to the first movable electrode 14.

Next, an operation of the electromechanical switch according to the first embodiment is described below.

Referring to FIGS. 2 and 4, when a drive control voltage is applied to the first movable electrode 14 in the initial condition, the first movable electrode 14 having a weak spring force is operated at high speed by an electrostatic force and is pulled in toward and is electrically connected to the fixed electrode 18. Thus, the first electromechanical switch 22 is brought into an on-state, so that the electromechanical switch 40 is turned on.

When the drive control voltage applied to the first movable electrode 14 and the second movable electrode 16 is canceled, the first movable electrode 14 and the second movable electrode 16 are pulled away from the fixed electrode 18 by a spring restoring force of each of the movable electrodes. First, the second electromechanical switch 24 is put into an off-state, so that the electromechanical switch 40 is turned off.

At that time, the second movable electrode 16 having a strong spring restoring force operates at a speed higher than a speed, at which the first movable electrode 14 having a weak spring restoring force, and is detached from the fixed electrode 18 to start performing natural vibrations.

In a case where when this vibrating second movable electrode 16 returns to the vicinity of the fixed electrode 16, a drive control voltage is applied thereto, the second movable electrode 16 is latched by the electrostatic force toward the fixed electrode 18. During that, the first movable electrode 15 is sufficiently away from the fixed electrode 18, so that the first electromechanical switch 22 is in an off-state. The electromechanical switch 40 remains turned off even when the second movable electrode 16 is latched, so that the second electromechanical switch 24 is put into an on-state.

Thus, the electromechanical switch according to the first embodiment can perform an on-response and an off-response at high speed according to the combination of the first electromechanical switch, which is put into an on-state at high speed, and the second electromechanical switch that is put into an off-state at high speed.

Next, an operation of the electromechanical switch in the case of employing inboard beams as the movable electrodes described in the description of the first embodiment is described in detail below by way of example.

In the case where the movable electrodes are constituted by inboard beams, as in the first embodiment, a constant k of spring of the movable electrode is expressed by an equation (1).

$$k=Ew(D/L)^3+8\sigma(1-\nu)w(D/L) \quad (1)$$

Incidentally, "E" represents Young's modulus, and "w" represents a line width of the movable electrode. "D" represents a thickness of the movable electrode. "L" represents a length of the movable electrode, and "σ" represents an internal stress, and "ν" represents a Poisson's ratio.

As is apparent from the equation (1), the spring constant k can be changed by changing the shape, the material, and the physical property of the movable electrode.

Next, a motion equation in the case of applying an external force F to the movable electrode is given by the following equation (2).

$$md2Z(t)/dt2+b(1.2-Z(t)/g)-3/2Z(t)+kZ(t)=F \quad (2)$$

Incidentally, "Z(t)" represents the position of the movable electrode with respect to the fixed electrode at a moment t, and "m" represents the mass of the movable electrode, and "b" represents a damping coefficient, and "g" represents an initial value of the distance between the electrodes, and "k" represents a spring constant of the movable electrode.

In the first electromechanical switch 22, the spring force of the first movable electrode 14 is extremely weak. The first movable electrode 14 is designed to respond to a minute driving force. Thus, when the first movable electrode 14 is pulled in, the first movable electrode 14 can be pulled in by responding to the driving force at high speed even when the driving force is minute.

For example, in a case where aluminum (the internal stress is 50 MPa, the Young's modulus is 70 GPa, the Poisson's ratio is 0.25, and the density is 2.69 kg/m3) is used as the material of the first movable electrode 14, where data representing the shape thereof, that is, the width w1 is 2.5 μm, the thickness D is 0.4 μm, and the length L is 500 μm, and where the gap between the electrodes g1 is 0.2 μm, the first movable electrode is pulled in toward the fixed electrode 18 in 0.2 μs when a voltage of 8V is applied thereto.

Figure 5:
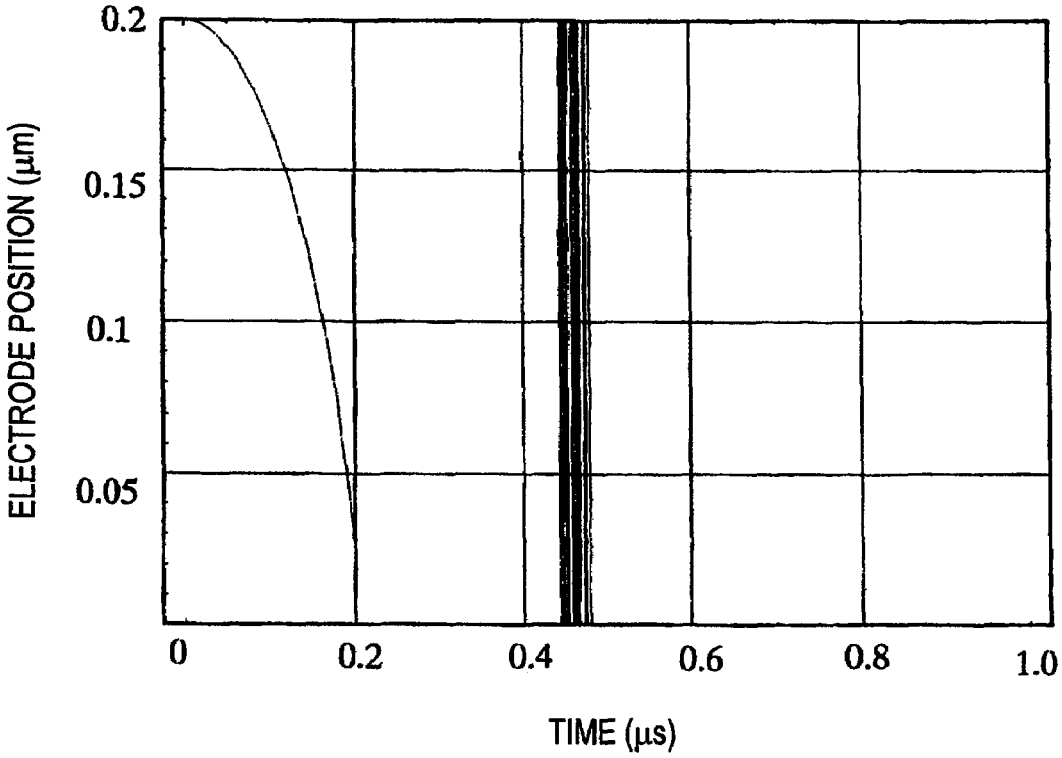
FIG. 5 is a graph whose ordinate axis represents the position of a first movable electrode with respect to a fixed electrode and whose abscissa axis represents time.

FIG. 5 is drawn so that an abscissa axis represents time and that an ordinate axis represents the position of the first movable electrode with respect to the fixed electrode by solving the motion equation (2). Thus, FIG. 5 shows a transient phenomenon of change in position of the first movable electrode in a case where a driving voltage is applied thereto at a moment 0. In a case where the position of the electrode is 0, this position indicates a place at which the fixed electrode 18 and the first movable electrode 14 are in contact with each other.

As is seen from FIG. 5, the first movable electrode 14 is pulled into toward and is in contact with the fixed electrode 18 within 0.2 μs.

At that time, in a case where the first movable electrode 14 serving as a thin structure is caused to perform an operation at high speed, the operation becomes complex by being affected by fluids, such as ambient air. Thus, the influence of the fluid is non-negligible.

Accordingly, to alleviate such a damping effect, an enclosed space is formed in the inside of the switch, in which the beams and so on are formed, so that the magnitude of the damping effect in the switch is (1/25) the magnitude of the damping effect in the atmospheric air.

Next, an off-operation of the first electromechanical switch is described below.

As is apparent from the equation (2), when the control voltage is turned off to cancel the driving force, the first movable electrode returns to an initial position by employing the spring force thereof as a driving force. However, because the spring force is weak, a response time is longer than that in the case of turning on the switch.

Figure 6:
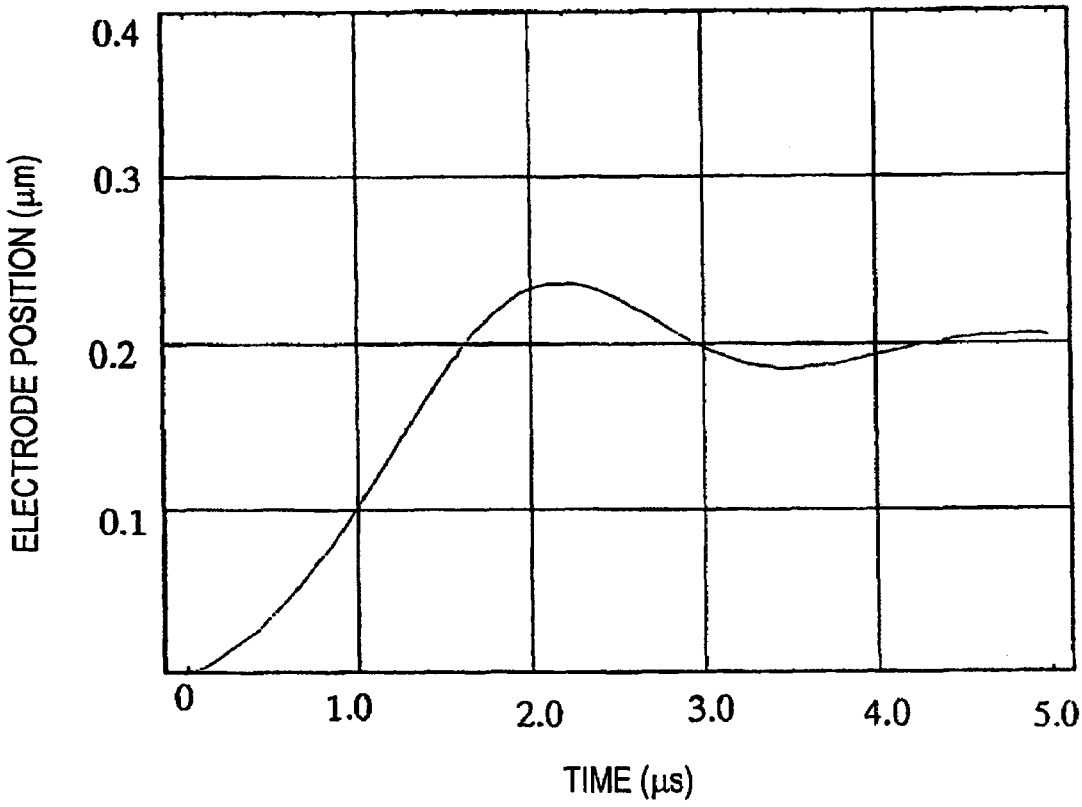
FIG. 6 is a graph illustrating a transient response at the position of the first movable electrode in a case where a drive control voltage is set to be off at a position at which the first movable electrode and a fixed electrode are in contact with each other.

FIG. 6 is a graph illustrating a transient response at the position of the first movable electrode in a case where a drive control voltage is set to be off at a position at which the first movable electrode and the fixed electrode are in contact with each other.

As shown in FIG. 6, when the electrostatic force is canceled at the moment 0 at the position at which the first movable electrode 14 and the fixed electrode 18 are in contact with each other, the first movable electrode 14 returns to the initial position having a value of 0.2 μm in 1.6 μs (about 2 μs) by employing the spring force of the first movable electrode 14 as a restoring force. Thus, it turns out that the response time required to return thereto in the case of the off-operation is about 10 times the response time of 0.2 μs, which is required to return to the initial position in the case of the on-operation.

Consequently, although a high-speed on-operation is enabled only by using the first electromechanical switch 22, it is difficult to enable a high-speed off-operation.

Next, the structure of the second electromechanical switch 24 and an operation thereof are described below.

The second movable electrode 16 of the second electromechanical switch is configured so that the spring force thereof is extremely strong. In a case where the second electromechanical switch 24 is formed in the same shape as that of the first electromechanical switch 22, it is advisable to increase the gap g2 between the electrodes. Alternatively, it is advisable to configure the movable electrode according to the equation (1) so that the spring constant is increased.

For example, aluminum (the internal stress is 50 MPa, the Young's modulus is 70 GPa, the Poisson's ratio is 0.25, and the density is 2.69 kg/m$^3$) may be used as the material of the second movable electrode. Also, the second movable electrode may be configured to have a shape so that the width w2 is 2.5 μm, that the thickness D is 0.4 μm, that the length L is 500 μm, and that the gap between the electrodes g2 is 1.5 μm.

Figure 7:
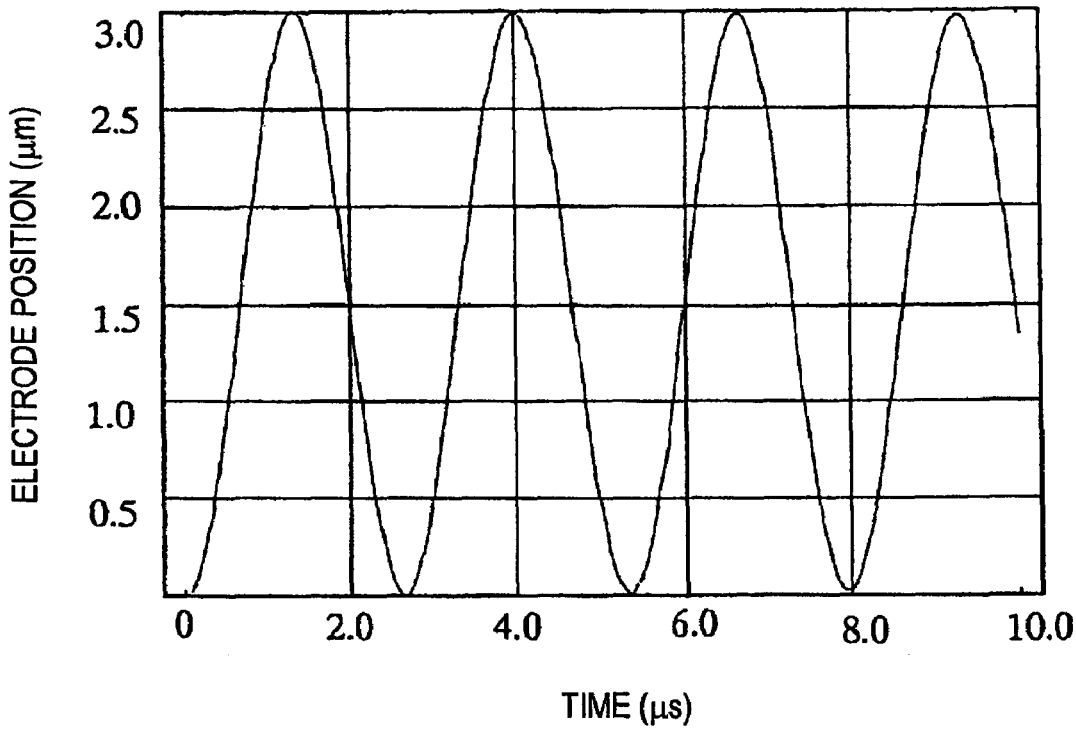
FIG. 7 is a graph illustrating a transient response at the position of a second movable electrode of the second electromechanical switch.
Figure 8:
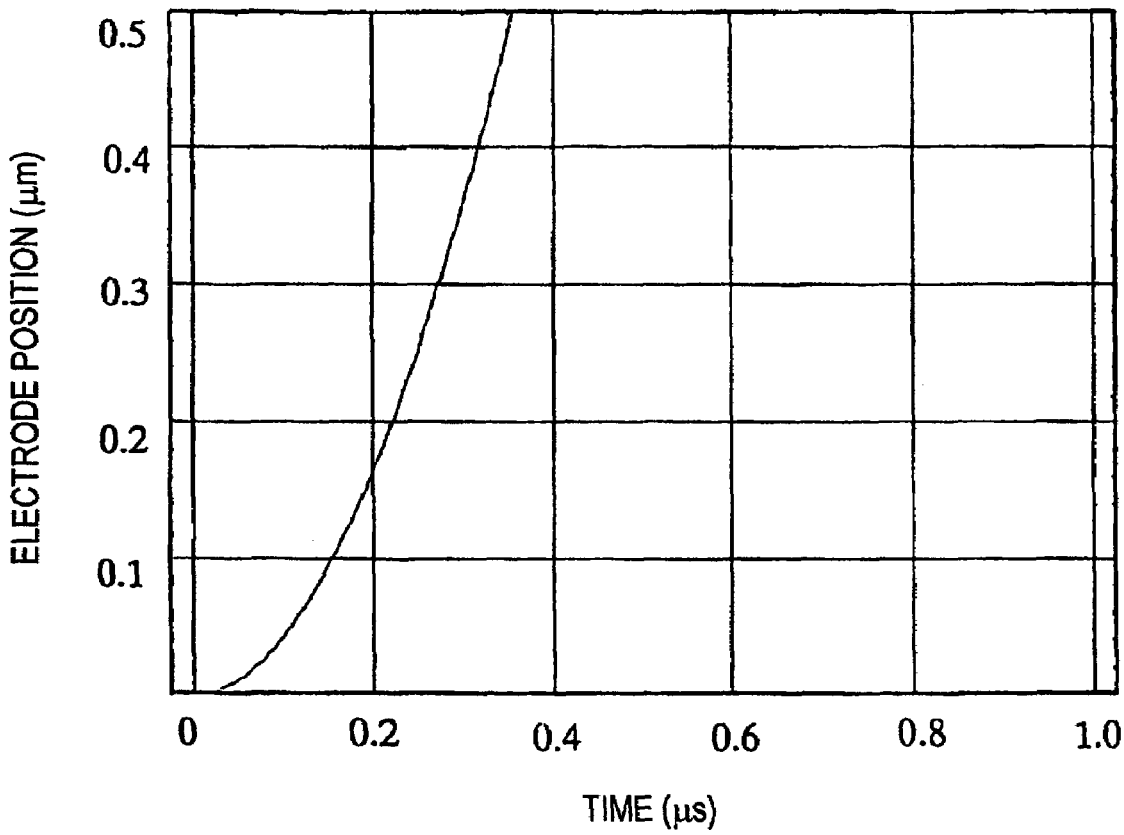
FIG. 8 is a graph enlargedly illustrating a behavior that corresponds to time which is 1 μs or less, and that is shown in FIG. 7 illustrating the transient response at the position of the second movable electrode.

FIGS. 7 and 8 show a transient response at the position of the second movable electrode of the second electromechanical switch at the cancellation of a control voltage at a position, at which the second movable electrode and the fixed electrode are in contact with each other, in a case where no external force is applied (the second movable electrode is not latched). Incidentally, FIG. 8 enlargedly illustrates a behavior that corresponds to time which is 1 μs or less, and that is shown in FIG. 7.

With such a configuration of the second electromechanical switch, the spring force of the second movable electrode is stronger than that of the first movable electrode of the first electromechanical switch. Also, the damping force of the second movable electrode is weaker than that of the first movable electrode of the first electromechanical switch. Thus, as shown in FIG. 7, the second movable electrode changes the position from the position of the fixed electrode while the second movable electrode vibrates at the natural frequency.

As shown in FIG. 8, within 0.2 μs, the position of the second movable electrode reaches 0.16 μm (about 0.2 μm). Further, as shown in FIG. 7, within 1 μs is, the second movable electrode passes through the initial position that is 1.5 μm. Then, the electrode overshoots and reaches a maximum displacement position of 3 μm in 1.5 μs. Subsequently, the electrode returns to the vicinity of a position corresponding to a displacement of 0 in 2.5 μs.

Thus, the environment is established so that the damping of the second movable electrode is suppressed. Consequently, the position of the electrode gradually converges to the position corresponding to 1.5 μm.

Next, a switching operation of the electromechanical switch according to the invention, which is the combination of the first electromechanical switch and the second electromechanical switch, is described below in detail.

First, an operation of changing an off-state to an on-state of the electromechanical switch according to the invention is described below.

Figure 9:
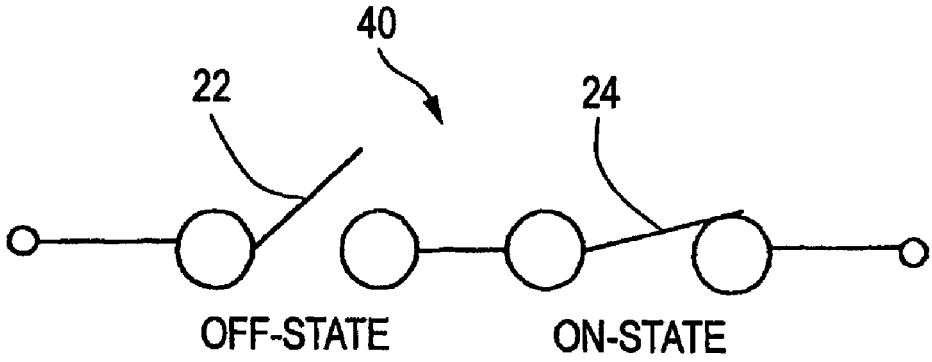
FIG. 9 is a view illustrating an on-state and an off-state of the electromechanical switch according to the first embodiment, each of which is shown with an equivalent circuit, and including (a) and (b) that show the off-state and the on-state, respectively.
Figure 9:
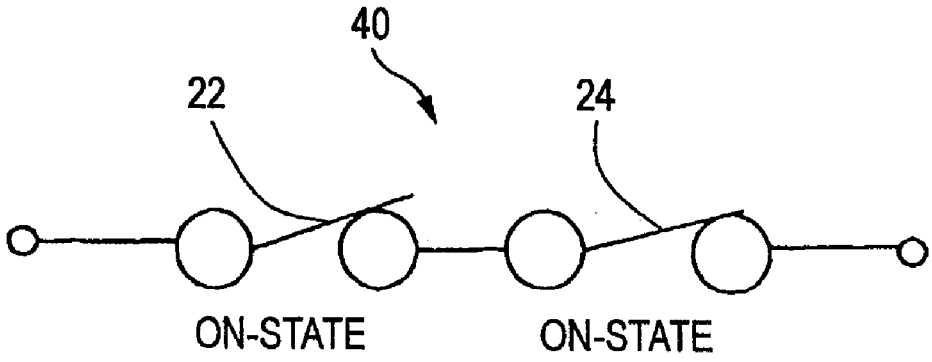

FIG. 9 is a view illustrating an on-state and an off-state of the electromechanical switch, each of which is shown with an equivalent circuit.

As shown in FIG. 9(*a*), in an off-state of the electromechanical switch according to the invention, the first electromechanical switch 22 is in an off-state, while the second electromechanical switch 24 is in an on-state. That is, no control voltage is applied to the first electromechanical switch 22. A control voltage is applied to the second electromechanical switch 24. Thus, the second movable electrode is latched to the fixed electrode.

When the drive control voltage is applied to the first electromechanical switch 22 in this state, the first movable electrode is pulled in toward the fixed electrode. Then, the first movable electrode and the fixed electrode are put into contact with each other and are electrically connected to each other. Thus, as shown in FIG. 9(*b*), the electromechanical switch is brought into an on-state. At that time, as described above, the first movable electrode of the first electromechanical switch is pulled in at high speed in 0.2 μs. Consequently, a signal is transmitted in 0.2 μs.

As shown in (a) and (b) of FIG. 9, the second electromechanical switch 24 always maintains a state, in which the drive control voltage is applied thereto, that is, an on-state in a transient state in which the first electromechanical switch 22 is changed from an off-state to an on-state.

Next, an operation of changing an on-state to an off-state of the electromechanical switch according to the invention is described below.

Figure 10:
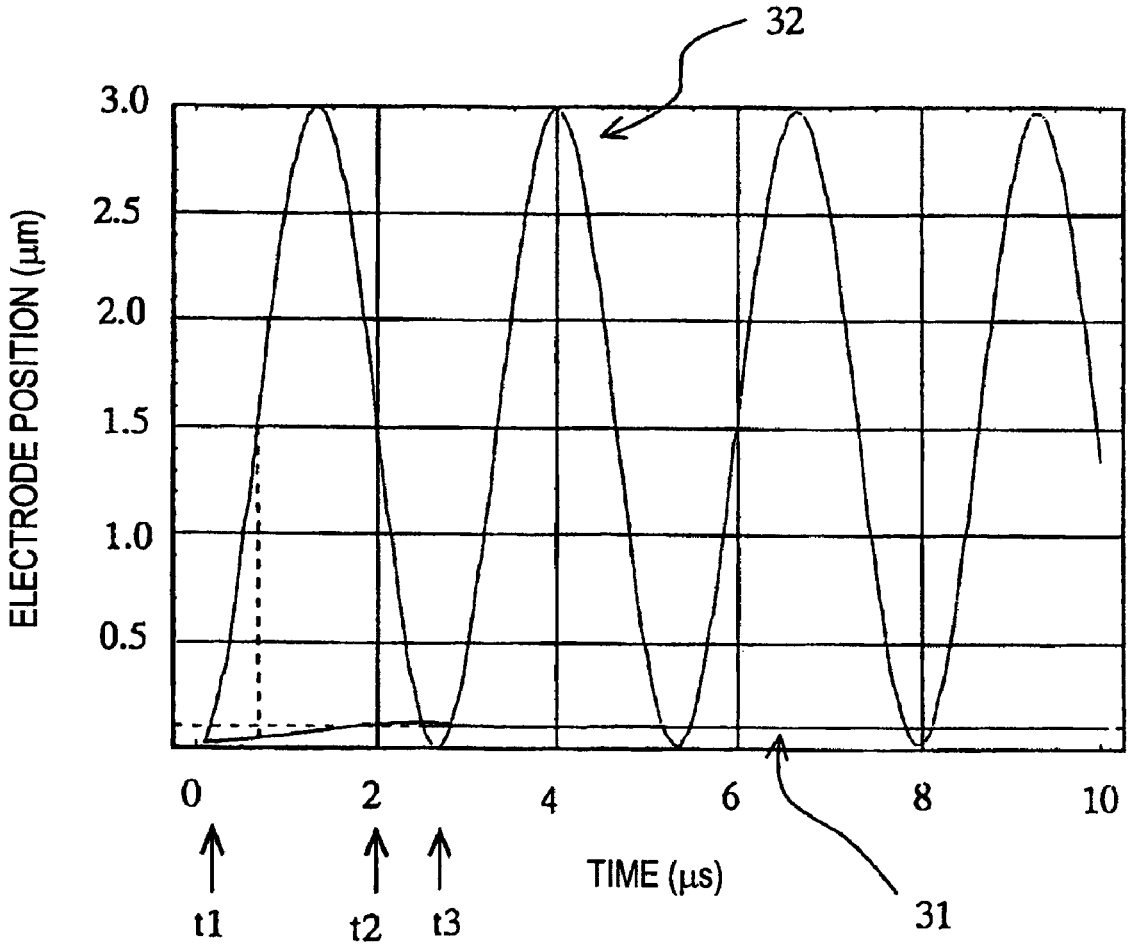
FIG. 10 is a graph illustrating both of the transient response at the position of the movable electrode of the first electromechanical switch and the transient response at the position of the movable electrode of the second electromechanical switch.

FIG. 10 illustrates both of the positions of the movable electrodes of the first electromechanical switch and the second electromechanical switch. A curve 31 indicates the position of the movable electrode of the first electromechanical switch. A curve 32 indicates the position of the movable electrode of the second electromechanical switch.

Figure 11:
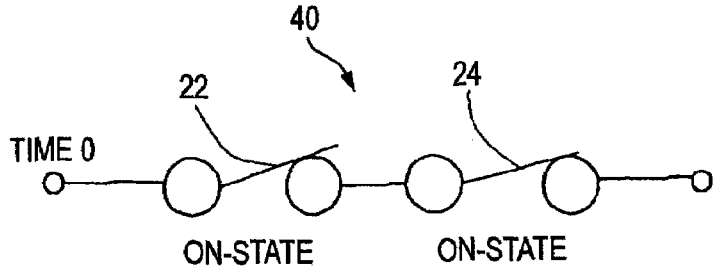
FIG. 11 is a view illustrating the states of the first electromechanical switch and the second electromechanical switch at each of moments with an equivalent circuit and including (a), (b), (c) and (d) that show the states correspond to moments 0, t1, t2, and t3, respectively.
Figure 11:
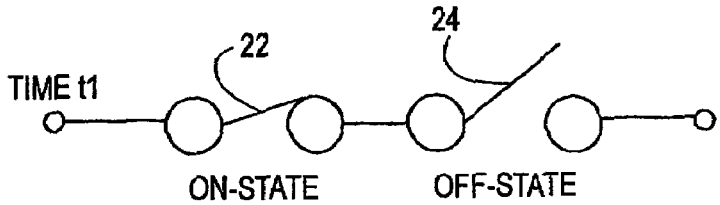
Figure 11:
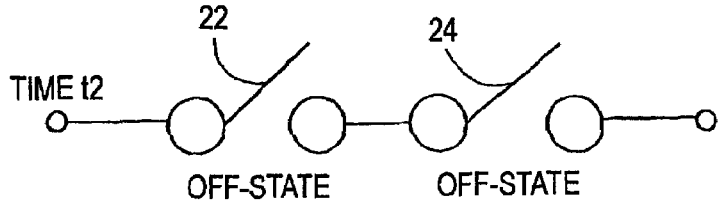
Figure 11:
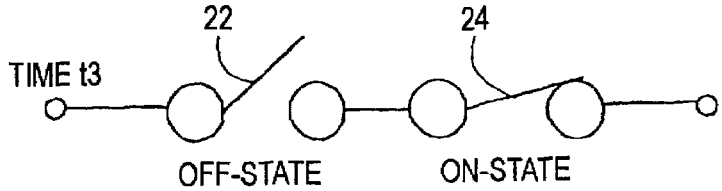

The states of the first electromechanical switch and the second electromechanical switch at each moment are shown with an equivalent circuit in (a) to (d) of FIG. 11.

In the on-state of the electromechanical switch according to the invention, both of the first electromechanical switch and the second electromechanical switch are in an on-state, that is, the movable electrodes are in contact with the fixed electrode, so that values of the positions of the movable electrodes are 0. The drive control voltage is applied to both of the first electromechanical switch and the second electromechanical switch.

When the drive control voltage applied to the first electromechanical switch 22 and the second electromechanical switch 24 at a moment 0 is set to be 0, as shown in FIG. 10, at a moment t1 (about 0.25 μs), the position of the second movable electrode of the second electromechanical switch is 0.2 μm. Thus, isolation can be ensured singly by the second electromechanical switch 24. Also, the electromechanical switch of the invention operates at high speed and is then brought into an off-state.

At a moment t2 (about 2 μs), the position of the second movable electrode of the second electromechanical switch 24 is near to the initial position, that is, 1.5 μm or so, while the first movable electrode of the first electromechanical switch 22 reaches the position of 0.2 μm. Thus, sufficient isolation can be ensured singly by the first electromechanical switch 22.

At a moment t3 (about 2.5 μs), the second movable electrode of the second electromechanical switch 24 returns to the latching position, that is, the vicinity to the position corresponding to a displacement of 0.

At this moment t3, the first electromechanical switch 22 singly has already ensured isolation. Thus, even in a case where a drive control voltage is applied to the second electromechanical switch 24 in this state to thereby latch the second movable electrode, the entire electromechanical switch according to the invention sufficiently ensures isolation of high-frequency signals.

The control voltage required to perform this latch can be a minute voltage, because the gap between the returned second movable electrode and the fixed electrode is small.

Thus, according to the invention, an electromechanical switch having a high-speed response characteristic can be realized by combining the first electromechanical switch with the second electromechanical switch.

Figure 12:
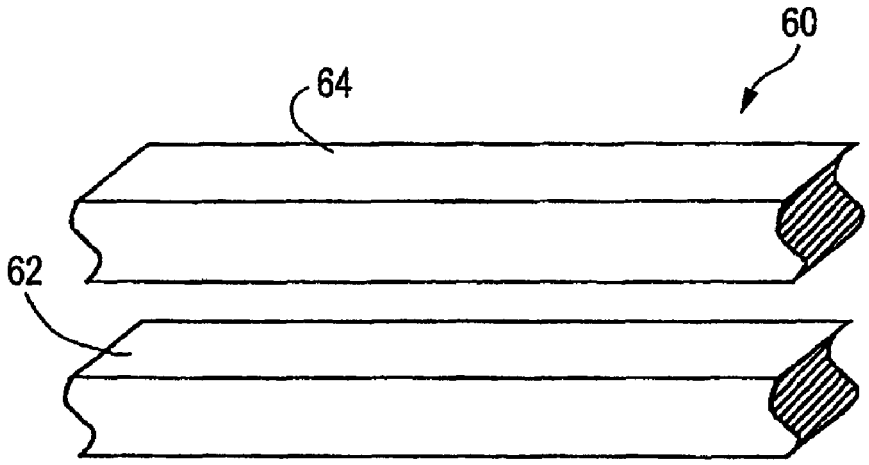
FIG. 12 is a view illustrating the structure of each of a parallel plate type electrode and a pectinate type electrode.
Figure 12:
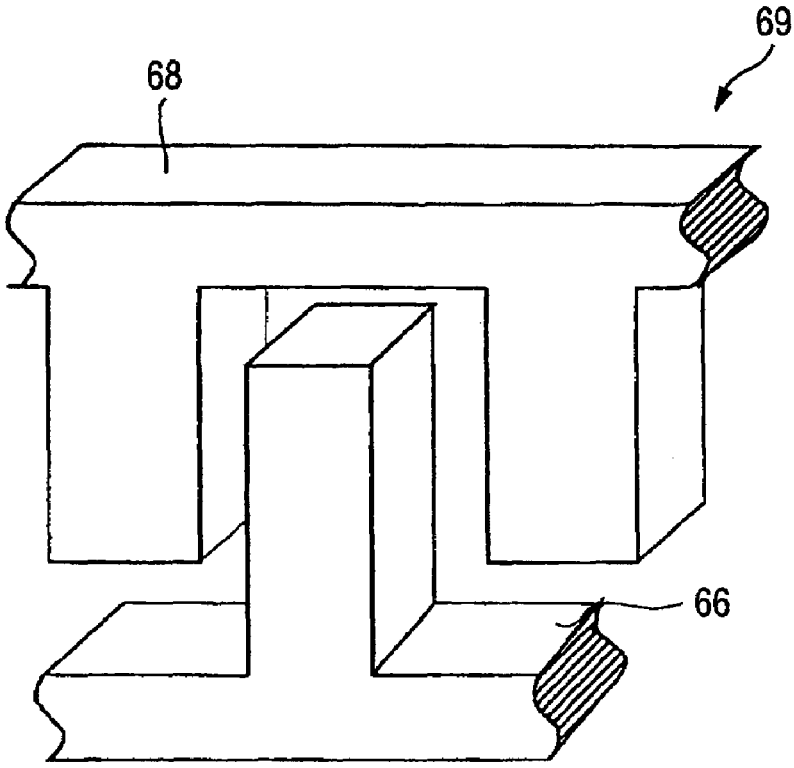

According to the first embodiment, as shown in FIG. 12(*a*), the fixed electrode 62 and the movable electrode 64 are of the parallel plate type ones 64. However, as shown in FIG. 12(*b*), a fixed electrode 66 and a movable electrode 68 may be of the pectinate type ones 69.

The electromechanical switch may be configured as a capacity type switch by forming dielectric substances on one or both of surfaces that the movable electrodes and the fixed electrode face.

Also, although aluminum has been cited as the material of the movable electrodes, other metallic materials, for example, Mo, Ti, Au, and Cu may be used, instead of Al. Alternatively, electrically conductive materials may be used.

Also, a beam structure configured by depositing metal portions, whose sizes are of the order of nanometers, on a surface of a plate-like silicon material may be employed as the movable electrode. Also, a piezoelectric element, a shape-memory alloy, an electromagnetic distortion element, and a bimorph element utilizing a bimorph effect may be utilized as the movable electrode.

Although the movable electrode is pulled in toward the fixed electrode formed on the substrate in a case where the electrodes of the parallel plate type and the pectinate type are employed, the movable electrodes may be configured to operate horizontally with respect to the substrate.

Figure 13:
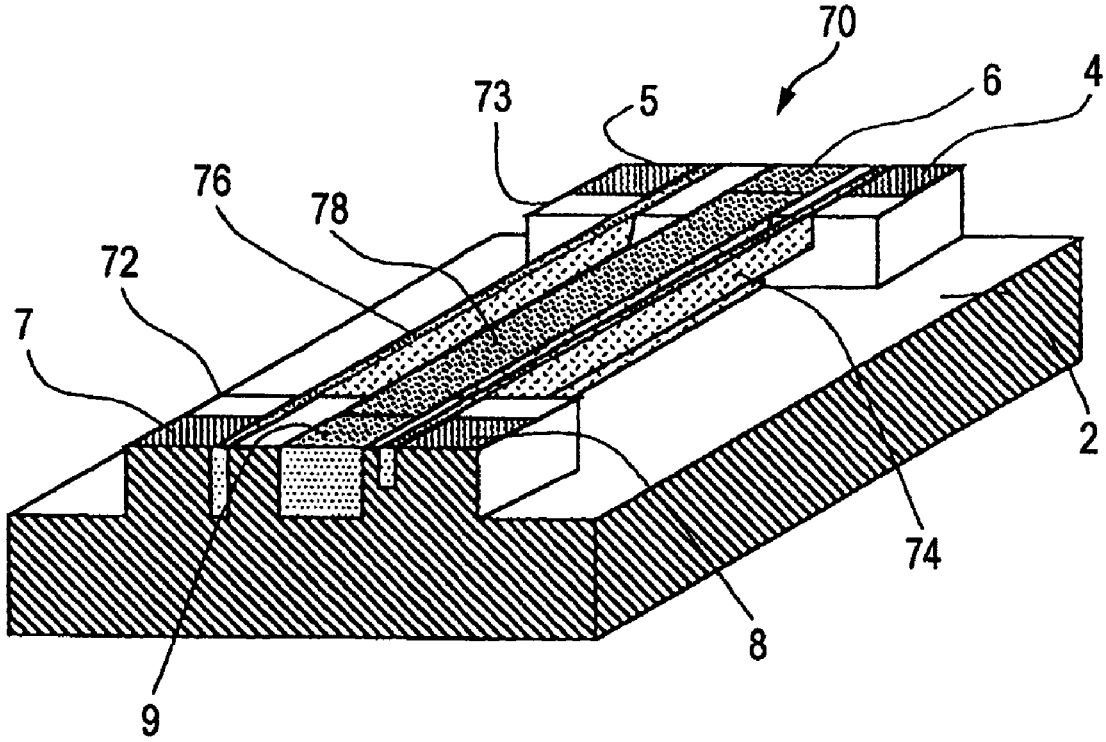
FIG. 13 is a schematic view of an electromechanical switch in which a movable electrode operates in a horizontal direction.

Next, a modification of the first embodiment of the invention is described below. FIG. 13 is a schematic view of an electromechanical switch in which a movable electrode operates in a horizontal direction.

As shown in FIG. 13, an electromechanical switch 70 has a first movable electrode 74 and a second movable electrode 76, the both ends of each of which are fixed to and laid on a first anchor 72 and a second anchor 73 formed on the silicon substrate 2, and also has a fixed electrode 78 formed between these movable electrodes to be thicker than each of the movable electrodes. The first movable electrode 74 and the second movable electrode 76 are formed in parallel to the fixed electrode 78 so that a predetermined gap is provided between the fixed electrode and each of the movable electrodes.

The gap between the first movable electrode 74 and the fixed electrode 78 has a width that is equal to the maximum amplitude of the first movable electrode 74 that performs natural vibrations. The gap between the second movable electrode 76 and the fixed electrode 78 has a width that is equal to the maximum amplitude of the first movable electrode 76 that performs natural vibrations. These gaps differ from each other.

The first electromechanical switch is configured by including the first movable electrode 74 and the fixed electrode 78. The second electromechanical switch is configured by including the second movable electrode 76 and the fixed electrode 78.

For example, the first movable electrode 74 is shaped so that the thickness is 2.5 μm, that the width is 0.4 μm, that the length is 500 μm, and that the gap between the first movable electrode 74 and the fixed electrode is 0.2 μm. The second movable electrode 76 is shaped so that the thickness is 5 μm, that the width is 0.4 μm, that the length is 500 μm, and that the gap between the second movable electrode 74 and the fixed electrode is 1.5 μm. The movable electrodes are shaped in this manner, so that the modification has advantages similar to those of the first embodiment.

Incidentally, the same members as those shown in FIG. 2 are designated by the same reference numeral.

In the electromechanical switch 70 of this configuration, the first movable electrode 74 and the second movable electrode 76 horizontally operate with respect to the substrate.

In a case where the movable electrodes horizontally operate with respect to the substrate, the gap between the first electromechanical switch and the fixed electrode and the gap between the second electromechanical switch and the fixed electrode can easily be formed so that these gaps differ from each other. The remaining operations are similar to those of the first embodiment.

The above electromechanical switch is not necessarily driven by the electrostatic force. For example, an electromagnetic force, heat obtained using a heat source, and a piezoelectric element may be used to drive the electromechanical switch.

The above electromechanical switch can be used as an antenna diversity DPDT (Dual Pole Double Throw) switch for a wireless LAN or the like required to perform high-speed switching.

Next, a method of manufacturing the electromechanical switch according to the first embodiment is described below.

Figure 14:
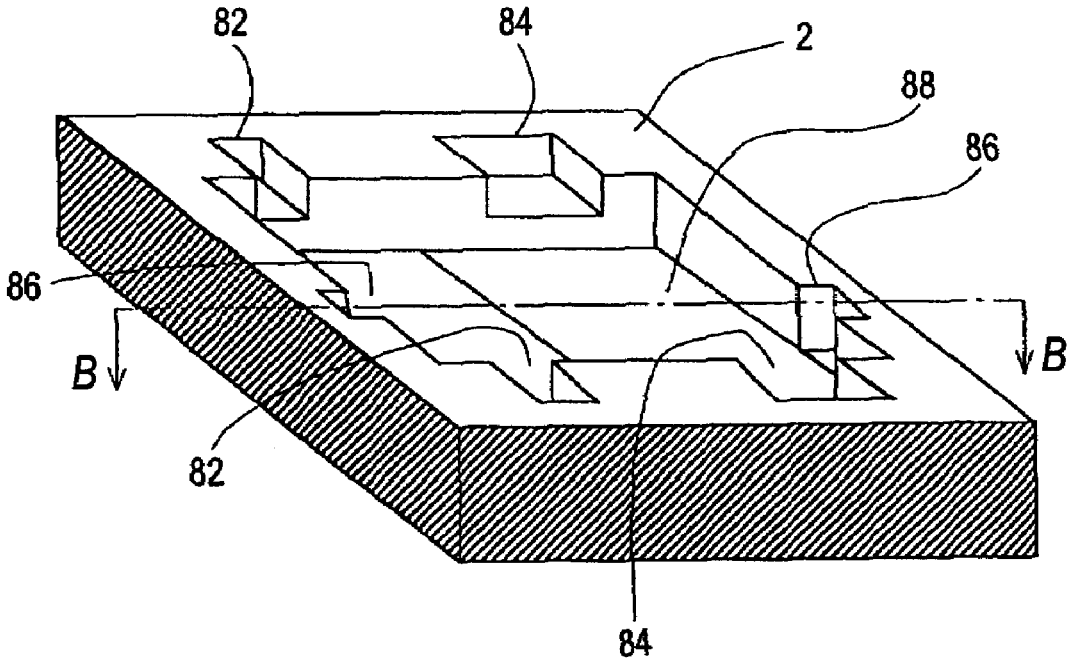
FIG. 14 is an external view of a silicon substrate in which a unit element of the electromechanical switch is formed.

FIG. 14 is an external view of a silicon substrate in which a unit element of the electromechanical switch is formed.

The silicon substrate 2 shown in FIG. 14 is formed into a predetermined shape by applying a resist film thereto, and then exposing the substrate with a predetermined mask pattern, and subsequently performing development/etching, and thereafter removing the resist film.

In the silicon substrate 2, a pair of first concave portions 82 used to fix and lay the first movable electrode, a pair of second concave portions 84 used to fix and lay the second movable electrode 16, a pair of third concave portions 86 used to take out the fixed electrode terminal therefrom, and a pair of fourth concave portions 88 used to form the fixed electrode 18.

Figure 15:
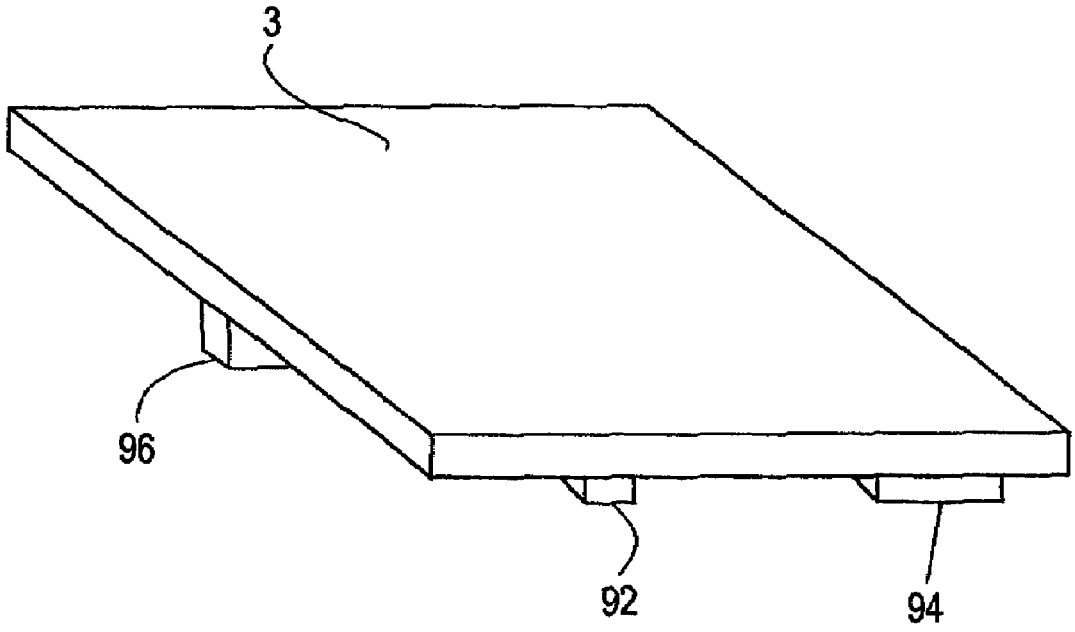
FIG. 15 is an external view of a sealed cover glass.

FIG. 15 is an external view of a sealed cover glass.

The sealed cover glass 3 is shaped like a plate and has pairs of projection portions 92, 94, and 96, which respectively correspond to the first concave portions 82, the second concave portions 84, and the third concave portions 86 provided in the silicon substrate 2.

Figure 16:
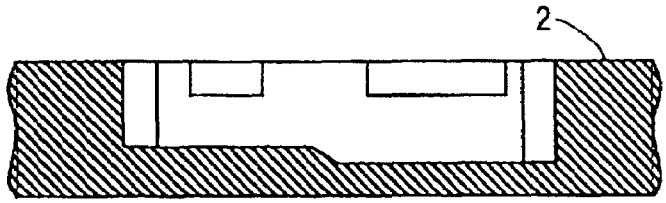
FIG. 16 is a cross-sectional view, which is taken on line B-B shown in FIG. 14 and which illustrates each of the steps of a process of manufacturing the electromechanical switch according to the first embodiment.
Figure 16:
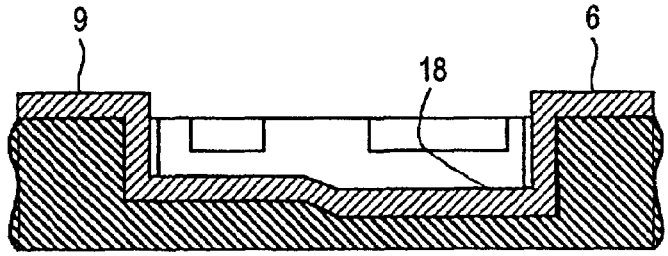
Figure 16:
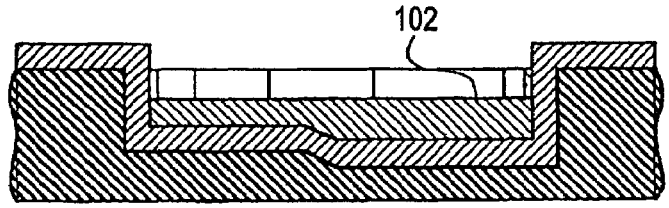
Figure 16:
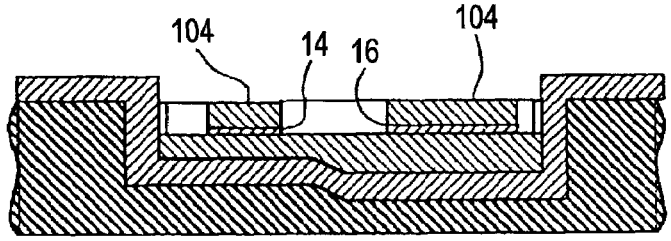
Figure 16:
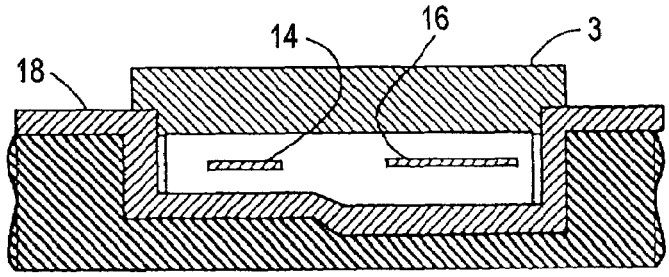

FIG. 16 including views (a) to (e) is a diagram illustrating a process of manufacturing this electromechanical switch. FIG. 16(*a*) is a cross-sectional view, which is taken on line B-B shown in FIG. 14. Each of the remaining views is a cross-sectional view showing the same section of this electromechanical switch.

First, an Al-layer is deposited on the silicon substrate 2 by vacuum-evaporation or sputtering. Then, a resist film having a predetermined pattern is applied thereonto. Subsequently, the Al-layer is wet-etched or dry-etched by using this resist film as a mask. Thus, the fixed electrode 18, the third electrode terminal 6, and the sixth electrode terminal 9 are formed (see FIG. 2 and FIG. 16(*b*)).

Subsequently, a sacrifice layer 102 is formed by resist (see FIG. 16(*c*)). Then, an Al-layer is deposited on this sacrifice layer by sputtering. Thereafter, the AL-layer is dry-etched by ECR-plasma using the resist film 104 having a predetermined pattern as a mask. Thus, the first movable electrode 14 and the second movable electrode 16 are formed (see FIG. 16(*d*)).

Then, the resist film 104 and the sacrifice layer 102 are removed by plasma-ashing. Thus, the beam structure of each of the first movable electrode 14 and the second movable electrode 16 is formed. In a pressure reducing apparatus or a helium filling apparatus, the alignment of the silicon substrate 2 with the sealed cover glass 3 is performed using the projection portions of the sealed cover glass 3. Subsequently, the sealed cover glass 3 and the silicon substrate 2 are anode-connected to each other (see FIG. 16(*e*)).

Thus, thin-film-like beam structures, such as the first movable electrode 14 and the second movable electrode 16, can be formed. Also, an electromechanical switch, in which an air gap located around each movable electrode adapted to perform an operation at high speed is depressurized or is filled with dry helium, can be manufactured.

SECOND EMBODIMENT

Next, a second embodiment is described below.

Figure 17:
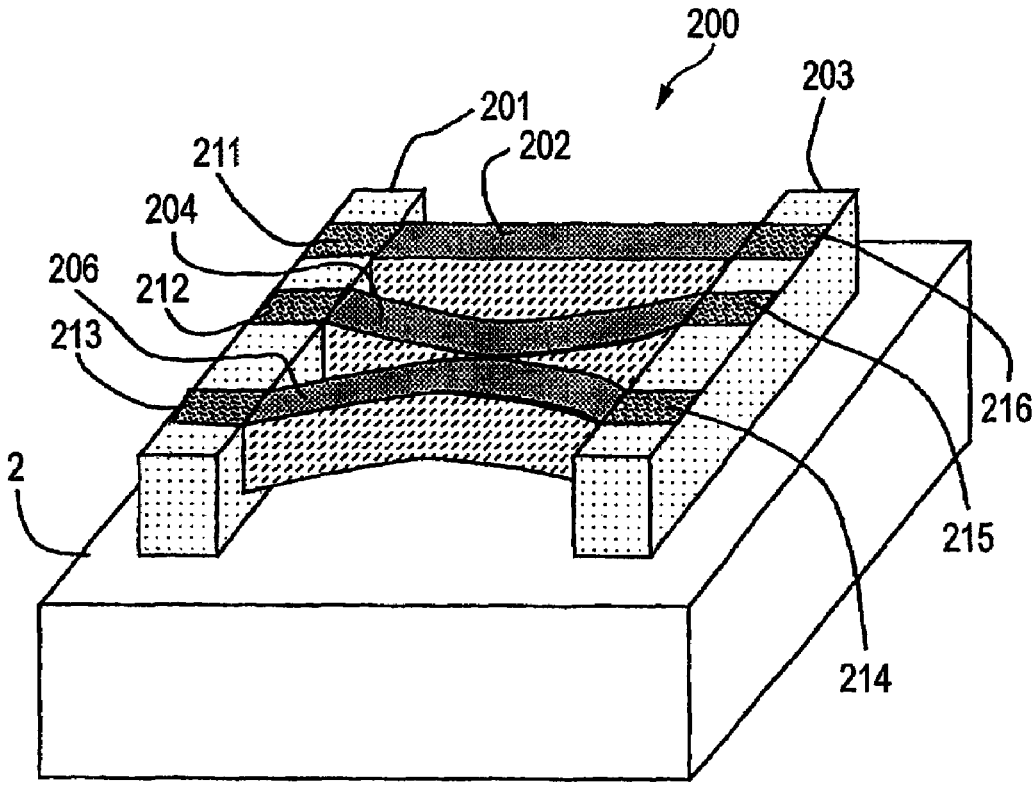
FIG. 17 is a schematic view illustrating the configuration of an example of a second embodiment.

FIG. 17 is a schematic view illustrating the configuration of an example of a second embodiment.

There is no limitation to the structure and the material of an electromechanical switch. As long as a response time, which is equal to or less than a desired value, of the electromechanical switch is obtained corresponding to the natural vibrations of a movable electrode by setting the shape and the material of the movable electrode, the set shape and material can be employed. In the second embodiment, the relative change of spring forces is performed.

As shown in FIG. 17, an electromechanical switch 200 according to the second embodiment has a first movable electrode 202, a second movable electrode 204, and a third movable electrode 206, the both ends of each of which are fixed to and laid on a first anchor 201 and a second anchor 203 formed on a silicon substrate 2. The movable electrodes are formed to face each other, to extend in parallel to each other and to have a predetermined gap provided between adjacent ones. The movable electrodes are configured as inboard beams and have different spring forces, respectively. The second movable electrode 203 is formed so that the spring force of the second movable electrode 203 is stronger than the spring forces of the first movable electrode 202 and the third movable electrode 206. The first movable electrode 202 and the third movable electrode 206 are configured so that the spring force of the first movable electrode 202 is equal to or differs from the spring force of the third movable electrode 206.

In the case of an example shown in FIG. 17, the electromechanical switch has a second electrode terminal 212 serving as a signal input terminal, and also has a fourth electrode terminal 214 and a sixth electrode terminal 216, which serve as signal output terminals. Thus, this electromechanical switch can be configured as a SPDT (Single Pole Dual Throw) switch.

Additionally, a first electrode terminal 211 and the sixth electrode terminal 216 are formed at an end of the first movable electrode 202. A second electrode terminal 212 and a fifth electrode terminal 215 are formed at an end of the second movable electrode 204. A third electrode terminal 213 and the fourth electrode terminal 214 are formed at an end of the third movable electrode 206. Each of the electrode terminals can be connected to a control voltage supply adapted to apply an electrostatic force between the movable electrodes facing each other.

In the electromechanical switch 200 shown in FIG. 17, a first electromechanical switch is configured by including the first movable electrode 202 and the second movable electrode 204. A second electromechanical switch is configured by including the second movable electrode 204 and the third movable electrode 206.

Incidentally, although not shown, the electromechanical switch 200 is covered with the sealed cover glass. The inside of the electromechanical switch 200 is maintained by being filled with dry helium or under reduced pressure.

Also, the electromechanical switch is configured so that a response time corresponding to the natural frequency of the second movable electrode 204 electrically connectable to the first movable electrode 202 and the third movable electrode 206 is equal to or less than a desired response time. Thus, the movable electrode can be displaced in a predetermined response time.

For example, in a case where the desired response times is 0.2 μs, the natural frequency should be equal or less than 5 MHz.

More specifically, to set the natural frequency at a value that is equal to or less than 5 MHz using the equations (1) and (2), for example, in a case where aluminum (the internal stress is 50 MPa, the Young's modulus is 70 GPa, the Poisson's ratio is 0.25, and the density is 2.69 kg/m3) is used as the material of the movable electrode, and where data representing the shape thereof, that is, the width w is 1 μm, the thickness D is 10 μm, and the length L is 50 μm, the natural frequency is 5 MHz. Additionally, the air gap among the movable electrodes is set to be 2.4 μm.

Basically, the second movable electrode 204 maintains a state in which the second movable electrode 204 is electrically connected to one of the first movable electrode 202 and the third movable electrode 206 always in the initial condition. That is, in the electromechanical switch 200, one of the first electromechanical switch and the second electromechanical switch is in an on-state, while the other electromechanical switch maintains an off-state.

In the example shown in FIG. 17, a drive control voltage is applied to the third movable electrode 206. The second movable electrode 204 and the third movable electrode 206 are brought in contact with each other by an electrostatic force or is capacity-coupled with each other. At that time, no drive control voltage is applied to the second movable electrode 204 and the first movable electrode 202.

Figure 18:
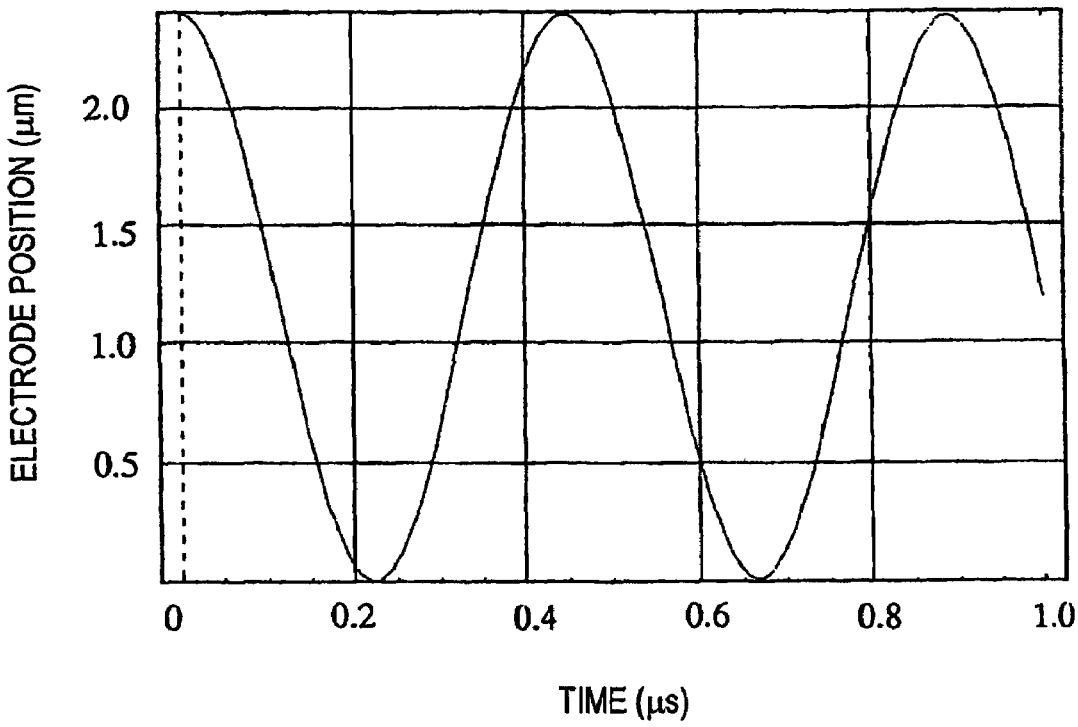
FIG. 18 is a graph illustrating the displacement of a second movable electrode in the second embodiment.

FIG. 18 is a graph illustrating the displacement of the second movable electrode.

In a case where the drive control voltage applied to the third movable electrode 206 is set to be 0 in the initial condition shown in FIG. 17 to thereby release the electrostatic force, the second movable electrode 204 oscillates between the first movable electrode 202 and the third movable electrode 206 at the natural frequency by the restoring force thereof, as shown in FIG. 18. At that time, the damping effect is reduced. Thus, the magnitude of the damping effect in the switch is (1/25) the magnitude of the damping effect in the atmospheric air.

Next, a switching operation of the second embodiment is described below.

Meanwhile, in a state in which the drive control voltage is applied to the third movable electrode 214 and in which the second movable electrode 204 and the third movable electrode 214 are in contact with each other, the drive control voltage is applied to the first movable electrode 202 at a moment 0 by simultaneously setting the drive control voltage applied to the third movable electrode 214 to be 0.

At that time, the second movable electrode 204 is displaced toward the first movable electrode 202 at high speed by a strong spring force. Moreover, the first movable electrode 202 having a relatively weak spring force responds to this due to an electrostatic force acting between the first movable electrode 202 and the second movable electrode 204. Then, the first movable electrode 202 goes closer to and latches the second movable electrode 204. At that time, a drive control voltage of 3V is sufficient to cause the first movable electrode 202 to latch the second movable electrode 204.

According to the electromechanical switch of this configuration, even at a low drive voltage, a switching operation can be performed at high speed.

Meanwhile, when no drive control voltage is applied thereto due to some reason, the second movable electrode 204 is not latched by the first movable electrode 202 or by the third movable electrode 206. Thus, the second movable electrode 204 can be put into a state in which the displacement thereof is 0.

A considerable drive control voltage is needed to pull in the second movable electrode 204 toward the first movable electrode 202 or the third movable electrode 206 by applying an electrostatic force thereto in this state of the second movable electrode 204 in which the displacement thereof is 0. In the case of the above movable electrode, it is necessary to apply 44V thereto.

Thus, to put one of the first electromechanical switch and the second electromechanical switch into an on-state, the second movable electrode is adapted to be pulled in by using another drive unit, instead of using an electrostatic force to be generated by applying a voltage between the movable electrodes.

For example, a structure element itself, which is deformed by applying a voltage thereto, for instance, a piezoelectric element, a shape-memory alloy, a bimorph element, and an electromagnetic distortion element may be used as the drive unit.

For example, instead of the second movable electrode 204, a second movable element adapted to be deformed by applying an initial voltage thereto may be provided. When this second movable element goes closer to the third movable electrode 206, a drive control voltage may be applied to the third movable electrode 206 to thereby latch the second movable element with an electrostatic force. Thereafter, the voltage applied to the second movable element may be canceled.

Alternatively, the second movable electrode 204 may be pulled in toward the first movable electrode 202 or the third movable electrode 206 through the use of a mechanical probe. A drive control voltage is applied to the first movable electrode 202 or the third movable electrode 206 when this second movable electrode 204 is pulled in.

With this configuration, a driving voltage to be applied to the first movable electrode 202 and the third movable electrode 206 can be reduced to be a low voltage. An electromechanical switch having a high speed switching characteristic can be provided.

THIRD EMBODIMENT

Figure 19:
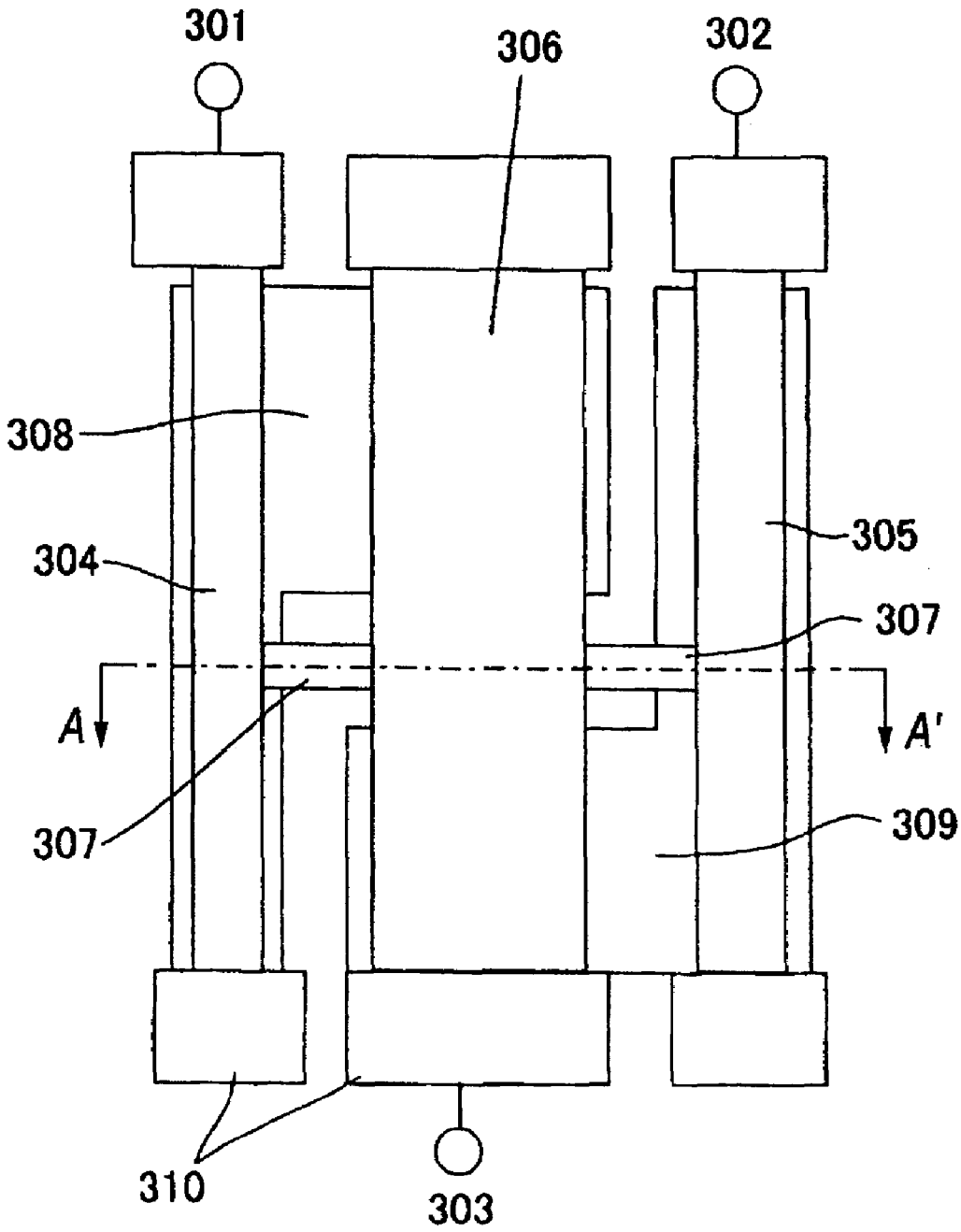
FIG. 19 is a schematic view illustrating an electromechanical switch according to a third embodiment.

Next, a third embodiment of the invention is described below. FIG. 19 is a top view illustrating an electromechanical switch according to the third embodiment of the invention. Similarly to the first embodiment, an electromechanical switch according to the third embodiment includes a plurality of switches having different spring forces. The third embodiment prevents an occurrence of a drawback that the second movable electrode having a strong spring force, which is in an off-state, cannot be pulled in even in a case where the first movable electrode is latched by the fixed electrode due to some failure, and that the second movable electrode is finally placed at an intermediate position, so that both of the first movable electrode and the second movable electrode are brought into an off-state, similarly to the first embodiment.

That is, in a case where a voltage needed for latching the first movable electrode to the fixed electrode due to some failure is not externally supplied thereto, each of the first movable electrode and the second movable electrode goes to an intermediate position through a free vibration, so that both of the first movable electrode and the second movable electrode are put into an off-state.

At that time, because the second movable electrode has a strong spring force, a high pull-in voltage is needed for pulling in the electrode in an off-state and latching the electrode.

The third embodiment provides the following structure to prevent occurrences of the above problem.

This switch includes an input terminal 303 and two output terminals 301 and 302, as shown in FIG. 19 illustrating the schematic configuration of this switch.

The input terminal 303 is connected to a higher spring movable electrode 306. The output terminals 301 and 302 are connected to a first lower spring movable electrode 304 and a second lower movable electrode 305, respectively. The relative magnitudes of the spring forces of the higher spring movable electrode, and the first and second lower movable differ from one another. The spring constant can be controlled according to the shape, the characteristic of the material, and the gap of the spring, similarly to the first embodiment. The movable electrodes 304 to 306 are fixed to the substrate by post portion 310. Also, the fist lower spring movable electrode 304 and the higher spring movable electrode 306 are mechanically connected to each other through a connecting portion 307. Similarly, the higher spring movable electrode 306 and the second lower spring movable electrode are mechanically connected to each other by a connecting portion 307. Additionally, a first fixed electrode 308 is formed at a region, with which the first lower spring movable electrode is in contact when displaced in a direction of the substrate, and at another region with which the higher spring movable electrode 306 is partly in contact when displaced in the direction of the substrate, The connecting portion 307 has a spring force smaller than the spring forces of the first and second lower spring movable electrodes and is constituted by an insulating member. The first fixed electrode 308 and a second fixed electrode 309 are spatially separated from each other. Both of the fixed electrode 308 and the second fixed electrode 309 are sufficiently electrically separated from each other. Unless the higher spring movable electrode 306 is in contact with the first or second electrode 308 or 309, the isolation between the first fixed electrode 308 and the second fixed electrode 309 is sufficiently established.

Next, a basic operation of the switch is described below. The present embodiment is applied as an SPDT switch. However, the present embodiment can be applied as an SPST switch. A method of outputting a signal, which is inputted from the input terminal 303, to the output terminal 301 is described below. A control signal is externally applied between the higher spring movable electrode 306 and the first lower spring movable electrode 304. A difference in potential is provided between the movable electrode and the fixed electrode to thereby generate an electrostatic force. Then, the first lower spring movable electrode 304 and the higher spring movable electrode 306 are pulled in toward the fixed electrode. Then, the higher spring movable electrode 306 and the first lower spring movable electrode 304 are in contact with and are electrically connected to the first fixed electrode 308. A signal inputted from the input terminal 303 is outputted from the output terminal 301 through the higher spring movable electrode 306, the first fixed electrode 308, and the first lower spring movable electrode 305. Similarly, in a case where the signal is outputted to an output terminal 302, it is advisable to pull in the second lower spring movable electrode 305 and the higher spring movable electrode 306 toward the substrate, and to electrically connect the second lower spring movable electrode 305 and the higher spring movable electrode 306 to the second fixed electrode 309.

Figure 20:
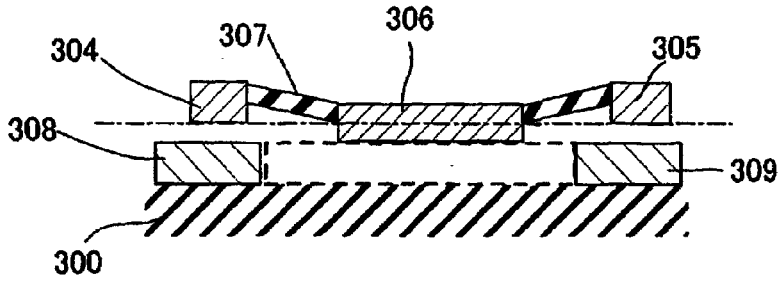
FIG. 20 is an explanatory view illustrating an operation of the third embodiment.
Figure 20:
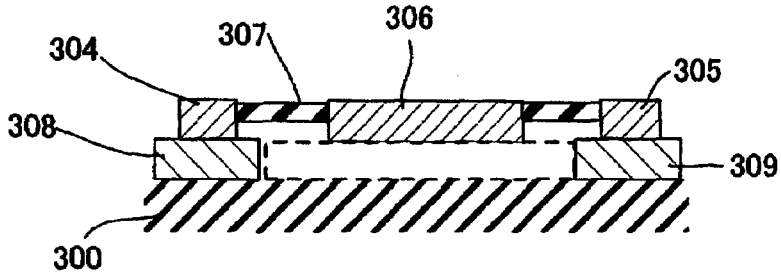
Figure 20:
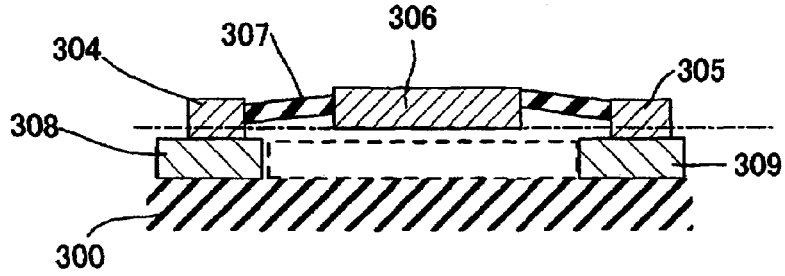
Figure 20:
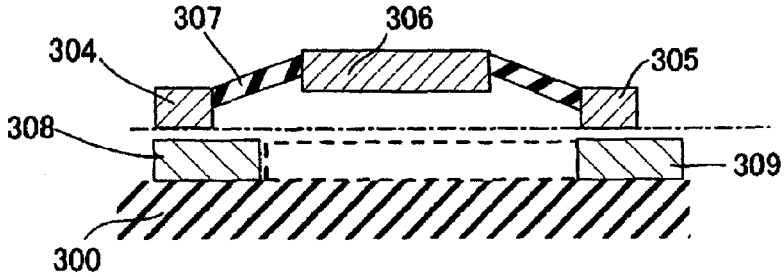
Figure 20:
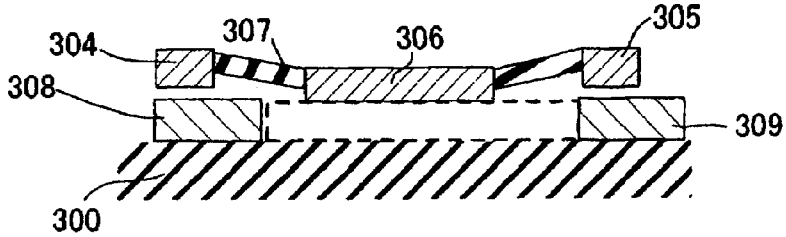

Next, a transient operation of the switch is described by referring to FIG. 20. FIG. 20 shows views each of which illustrates a cross-section taken on line A-A' shown in FIG. 19. At a moment (a), the lower spring movable electrodes 304 and 305 are in an off-state. The higher spring movable electrode 306 is latched and is in contact with the first fixed electrode 308 and the second fixed electrode 309. In this state, the first lower spring movable electrode and the second lower spring movable electrode are in an off-state. Thus, signals are shielded.

At that time, control signals are applied to the first and second lower movable electrodes. Thus, a difference in potential is provided therebetween to thereby generate an electrostatic force. The first lower spring movable electrode 304 and the second lower spring movable electrode 305 are pulled in toward the substrate. The first lower spring movable electrode 304 is in contact with and is electrically connected to the first fixed electrode 308. The second lower spring movable electrode 305 is in contact with and is electrically connected to the second fixed electrode 309. An insulating film is formed on at least one of contact surfaces between electrodes corresponding to each other, which are respectively selected from a set of the first lower spring movable electrode 304 and the second lower spring movable electrode 305 and a set of the first fixed electrode 308 and the second fixed electrode 309, respectively, to thereby prevent a DC current from flowing.

The first and second lower spring movable electrodes 304 and 305 have small spring forces. Thus, the first and second lower spring movable electrodes 304 and 305 are pulled in at high speed by a minute difference in potential. Thus, the switch is put into an on-state at a moment (b).

Next, an operation of turning off the switch, which is in this on-state, is described below. At a moment (b) at which the switch is in an on-state, the difference in potential, according to which the first and second lower spring movable electrodes 304 and 305 and the higher spring movable electrode 306 are latched, is canceled. Then, the first and second lower spring movable electrodes 304 and 305 and the higher spring movable electrode 306 are released and start performing free oscillations.

At that time, the higher spring movable electrode 306 having a strong spring force is released at high speed. However, the higher spring movable electrode 306 is connected to the first and second lower spring movable electrodes 304 and 305. Thus, a force of upwardly lifting the first and second lower spring movable electrodes 304 and 305 is generated at a moment (c) to assist the high-speed release of the first and second lower spring movable electrodes 304 and 305.

At a moment (d), the higher spring movable electrode 306 largely overshoots. However, at that time, this prevents the first and second lower spring movable electrodes 304 and 305, which are connected by the connecting portion 307, from largely overshooting.

Further, it is advisable to latch the higher spring movable electrode 306, which has returned to the side of the fixed electrode (that is, the first and second fixed electrodes 308 and 309) at a moment (f).

Thus, the higher spring movable electrode 306 is connected to the first and second lower spring movable electrodes 304 and 305 by the connecting portion 307. Consequently, the overshooting can be alleviated. Moreover, the high speed release of the first and second lower spring movable electrodes 304 and 305 can be assisted.

Figure 21:
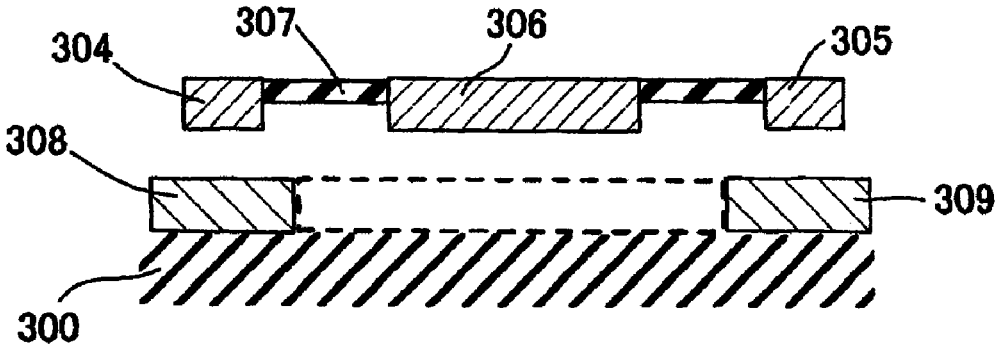
FIG. 21 is an explanatory view illustrating an operation of the third embodiment.
Figure 21:
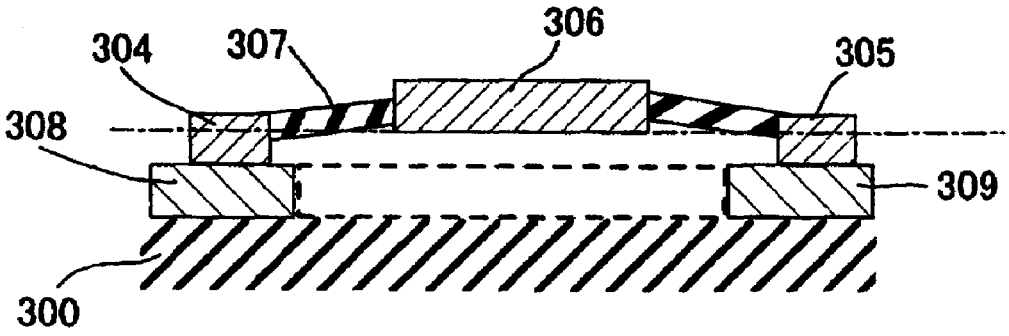

It is assumed that no voltage is applied to the electrode, which is adapted to latch the high spring movable electrode 306, due to some failure to thereby release the higher spring movable electrode 306, so that the switch is brought into a state shown in FIG. 21(*a*) through free oscillation. A high voltage is needed for pulling in the higher spring movable electrode 306 toward the side of the fixed electrodes (the first and second fixed electrodes 308 and 309) to latch the higher spring movable electrode 306 in this state.

Thus, first, as shown in FIG. 21(*b*), the first and second lower spring movable electrodes 304 and 305 are pulled in toward the fixed electrodes (the first and second fixed electrodes 308 and 309). At that time, the higher spring movable electrode 306 is connected to the first and second lower spring movable electrodes 304 and 305. Thus, the higher spring movable electrode 306 is displaced in the direction of the substrate. The electrostatic force is proportional to a negative square of the distance, so that a voltage required to pull in a higher spring movable electrode 306 can be lowered.

Also, in a case where a desired pull-in voltage is not obtained in this operation, the pull-in and the release of the first and second lower spring movable electrodes is repeated during the higher spring movable electrode performs natural vibrations. Then, the first and second lower spring movable electrodes are excited. The amplitude of the vibrations is increased. At a desired pull-in voltage, the movable electrode can be latched.

The connection state of the higher spring movable electrode and the first and second lower spring movable electrodes, which are connected by the connecting portion 307, can be controlled according to the mounting position of the connecting portion 307.

The movable electrode, both of the ends of which are fixed, does not perform oscillation with uniform amplitude in all regions. The movable electrode vibrates with a maximum amplitude in the vicinity of the center of the beam serving as a movable electrode. Conversely, the movable electrode hardly vibrates in the vicinity of the post portion 310. Thus, the connecting state of the movable electrode changes according to the position in the beam, at which the movable electrodes are connected to each other. In a case where the movable electrodes are connected to each other in the vicinity of a position at which the amplitude has a maximum value, the influence of the electrodes is maximized, so that the connection therebetween is very strong. That is, when the higher spring movable electrode 306 is released at a moment (c) shown in FIG. 20, the release of the first and second lower spring movable electrodes 304 and 305 with a strong force is supported. Conversely, the vibrations of the movable electrodes are inhibited. The vibrational energy of the higher spring movable electrode 306 is lost. The amplitude in free oscillation is reduced, so that the latching voltage is increased.

Conversely, in a case where the movable electrodes are connected to one another in the vicinity of the post portion 310, the state of the movable electrodes becomes close to a state in which no connecting portions 307 is provided. Thus, the release of the first and second lower spring movable electrodes is not assisted. Therefore, it is necessary to control the position of the connecting portion 307 to satisfy requested specifications.

Incidentally, in the description of the present embodiment, an example of employing two lower spring movable electrodes has been described. However, similar advantages are obtained by constituting the switch employing only one lower spring movable electrode.

INDUSTRIAL APPLICABILITY

The electromechanical switch according to the invention is enabled to operate at a low driving voltage and to turn on and off at high speed. The electromechanical switch according to the invention is usefully utilized as an RFMEMS switch, especially, an antenna diversity DPDT (Dual Pole Double Throw) switch for a wireless LAN required to perform high-speed switching.

The invention claimed is:

1. A main electromechanical switch, comprising: a first electromechanical switch that turns on and off based on a displacement of a first beam which is restorable by a first spring force; and a second electromechanical switch that turns on and off based on a displacement of a second beam which is restorable by a second spring force, the second spring force being stronger than the first spring force, wherein in an initial condition, the main electromechanical switch is brought into an off-state in which the first electromechanical switch is off and the second electromechanical switch is on.

2. The main electromechanical switch according to claim 1, wherein the first beam is displaced from the initial condition by one of application and cancellation of a driving force such that the first electromechanical switch is tuned on, thereby bring the electromechanical switch into an on-state.

3. The main electromechanical switch according to claim 1, wherein in a case that both of the first electromechanical switch and the second electromechanical switch are on, the displacement of the first beam and the displacement of the second beam are simultaneously canceled to perform a restoring operation so that the second electromechanical switch is turned off, thereby bring the electromechanical switch into an off-state.

4. The main electromechanical switch according to claim 1, wherein the second beam starts to perform natural vibrations by turning off the second electromechanical switch; and wherein the second beam is latched by one of application and cancellation of a driving force in a case where the second beam is returned to vicinity of a displacement position thereof at which the second electromechanical switch is turned off.

5. The main electromechanical switch according to claim 1, wherein at least one of a displacement of the first beam and a displacement of the second beam is based on an electrostatic force.

6. The main electromechanical switch according to claim 1, wherein at least one of a displacement of the first beam and a displacement of the second beam is based on an electromagnetic force.

7. The main electromechanical switch according to claim 1, wherein at least one of a displacement of the first beam and a displacement of the second beam is based on a piezoelectric effect.

8. The main electromechanical switch according to claim 1, wherein at least one of a displacement of the first beam and a displacement of the second beam is based on a thermal expansion.

9. The main electromechanical switch according to claim 1, further comprising a common fixed electrode, to which the first beam and the second beam face in parallel through an air gap, wherein the first electromechanical switch is configured by the fixed electrode and the first beam; and wherein the second electromechanical switch is configured by the fixed electrode and the second beam.

10. The main electromechanical switch according to claim 9, wherein the air gap to the fixed electrode is set to be smaller than a maximum amplitude of natural vibrations of each of the first beam and the second beam.

11. The main electromechanical switch according to claim 9, wherein the electromechanical switch is brought into an on-state only when the first electromechanical switch is on and the second electromechanical switch is on.

12. The main electromechanical switch according to claim 1, wherein the first beam and the second beam are arranged in parallel to each other; wherein a third beam enabled to be restored by a spring force, which is relatively weaker than the spring force of the second beam, is arranged in parallel thereto; wherein the first electromechanical switch is configured by the first beam and the second beam; and wherein the second electromechanical switch is configured by the second beam and the third beam.

13. The main electromechanical switch according to claim 12, wherein the air gap between the second beam and each of the first beam and the third beam is formed according to a maximum amplitude of natural vibrations of the second beam.

14. The main electromechanical switch according to claim 12, wherein in a case where all of displacements of the first beam, the second beam, and the third beam are canceled, the second beam is latched by displacing the third beam by one of application and cancellation of a driving force while the second beam is brought closer to the third beam by a mechanical probe.

15. The main electromechanical switch according to claim 1, wherein the first electromechanical switch and the second electromechanical switch are placed in environment in which an air pressure differs from an atmospheric pressure.

16. The main electromechanical switch according to claim 1, wherein the second electromechanical switch is off only for a time required by the first electromechanical switch to obtain predetermined isolation.

17. The main electromechanical switch according to claim 1, wherein a cycle of natural vibrations of the second beam is equal to a time required by the first beam to reach a position at which the first beam obtains sufficient isolation.

18. The main electromechanical switch according to claim 1, wherein a cycle of natural vibrations of the second beam is longer than a time required by the first beam to reach a position at which the first beam obtains sufficient isolation.

19. The main electromechanical switch according to claim 1, wherein a cycle of natural vibrations of the second beam is shorter than a time required by the first beam to reach a position at which the first beam obtains sufficient isolation.

20. The main electromechanical switch according to claim 1, wherein in a case where a state of a signal is switched from a passing state to a shielded state while the first electromechanical switch is on, the second beam reaches a position, at which the second beam obtains necessary isolation, until the first beam reaches a position required by the first beam to obtain predetermined isolation, and the second beam is returned to an initial latched state again.

21. The main electromechanical switch according to claim 1, further comprising: a lower spring movable electrode that is configured by the first beam; a higher spring movable electrode that is configured by the second beam, and is arranged in parallel to the lower spring movable electrode; and a first fixed electrode that is disposed to face the first beam and the second beam, wherein the first electromechanical switch includes the lower spring movable electrode including the first beam and the first fixed electrode; wherein the second electromechanical switch includes the higher spring movable electrode including the second beam and the first fixed electrode; wherein the first beam and the second beams are mechanically connected to each other through a connecting portion; and wherein the second beam is displaced in response to displacement of the first beam.

22. The main electromechanical switch according to claim 21, wherein the second beam is connected to an input terminal; and wherein the first beam and the second beam are connected to a first output terminal and a second output terminal, respectively.

* * * * *